US012345416B2

(12) United States Patent
Craig et al.

(10) Patent No.: US 12,345,416 B2
(45) Date of Patent: Jul. 1, 2025

(54) METHODS AND SYSTEMS FOR MINIMIZING $NO_x$ AND CO EMISSIONS IN NATURAL DRAFT HEATERS

(71) Applicant: MARATHON PETROLEUM COMPANY LP, Findlay, OH (US)

(72) Inventors: Jon Craig, Knoxville, TN (US); Bruce Li, Laguna Niguel, CA (US); Rick Pasi, Massillon, OH (US)

(73) Assignee: Marathon Petroleum Company LP, Findlay, OH (US)

( * ) Notice: Subject to any disclaimer, the term of this patent is extended or adjusted under 35 U.S.C. 154(b) by 0 days.

(21) Appl. No.: 18/238,308

(22) Filed: Aug. 25, 2023

(65) Prior Publication Data

US 2023/0400184 A1 Dec. 14, 2023

Related U.S. Application Data

(63) Continuation of application No. 15/929,932, filed on May 29, 2020, now abandoned.

(Continued)

(51) Int. Cl.

| | |
|---|---|
| ***F23N 1/02*** | (2006.01) |
| ***F23N 3/00*** | (2006.01) |
| ***F23N 5/24*** | (2006.01) |

(52) U.S. Cl.

CPC ..... *F23N 1/022* (2013.01); *F23N 3/002* (2013.01); *F23N 5/242* (2013.01);

(Continued)

(58) Field of Classification Search

None

See application file for complete search history.

(56) References Cited

U.S. PATENT DOCUMENTS

| | | | |
|---|---|---|---|
| 981,434 | A | 1/1911 | Lander |
| 1,526,301 | A | 2/1925 | Stevens |

(Continued)

FOREIGN PATENT DOCUMENTS

| | | |
|---|---|---|
| AT | 11772 U1 | 4/2011 |
| BR | PI0701518 | 11/2008 |

(Continued)

OTHER PUBLICATIONS

Lerh et al., Feature: IMO 2020 draws more participants into Singapore's bunkering pool., S&P Global Platts, www.spglobal.com, Sep. 3, 2019.

(Continued)

*Primary Examiner* — Jason Lau

(74) *Attorney, Agent, or Firm* — RAY QUINNEY & NEBEKER P.C.; Daniel J. Bezdjian

(57) ABSTRACT

Systems and methods for reducing $NO_x$ and CO emissions in a natural draft heater are disclosed. For example, the disclosure provides embodiments of systems and methods for controlling a draft value within a heater shell to deliver an amount of excess air to a burner to thereby maintain at least one of $NO_x$ emissions not exceeding 0.025 lb/MMBtu (HHV) and CO emissions not exceeding 0.01 lb/MMBtu (HHV) in a natural draft heater.

12 Claims, 11 Drawing Sheets

Related U.S. Application Data

(60) Provisional application No. 62/854,372, filed on May 30, 2019.

(52) U.S. Cl.
CPC ..... *F23N 2225/06* (2020.01); *F23N 2900/05001* (2013.01); *F23N 2900/05003* (2013.01)

(56) References Cited

U.S. PATENT DOCUMENTS 1,572,922 A 2/1926 Govers et al.
1,867,143 A 7/1932 Fohl
2,401,570 A 6/1946 Koehler
2,498,442 A 2/1950 Morey
2,516,097 A 7/1950 Woodham et al.
2,686,728 A 8/1954 Wallace
2,691,621 A 10/1954 Gagle
2,691,773 A 10/1954 Lichtenberger
2,731,282 A 1/1956 Mcmanus et al.
2,740,616 A 4/1956 Walden
2,792,908 A 5/1957 Glanzer
2,804,165 A 8/1957 Blomgren
2,867,913 A 1/1959 Faucher
2,888,239 A 5/1959 Slemmons
2,909,482 A 10/1959 Williams et al.
2,925,144 A 2/1960 Kroll
2,963,423 A 12/1960 Birchfield
3,063,681 A 11/1962 Duguid
3,070,990 A 1/1963 Stanley
3,109,481 A 11/1963 Yahnke
3,167,305 A 1/1965 Backx et al.
3,188,184 A 6/1965 Rice et al.
3,199,876 A 8/1965 Magos et al.
3,203,460 A 8/1965 Kuhne
3,279,441 A 10/1966 Lippert et al.
3,307,574 A 3/1967 Anderson
3,364,134 A 1/1968 Hamblin
3,400,049 A 9/1968 Wolfe
3,545,411 A 12/1970 Vollradt
3,660,057 A 5/1972 Ilnyckyj
3,719,027 A 3/1973 Salka
3,720,601 A 3/1973 Coonradt
3,771,638 A 11/1973 Schneider et al.
3,775,294 A 11/1973 Peterson
3,795,607 A 3/1974 Adams
3,838,036 A 9/1974 Stine et al.
3,839,484 A 10/1974 Zimmerman, Jr.
3,840,209 A 10/1974 James
3,841,144 A 10/1974 Baldwin
3,854,843 A 12/1974 Penny
3,874,399 A 4/1975 Ishihara
3,901,951 A 8/1975 Nishizaki
3,906,780 A 9/1975 Baldwin
3,912,307 A 10/1975 Totman
3,928,172 A 12/1975 Davis et al.
3,937,660 A 2/1976 Yates et al.
4,006,075 A 2/1977 Luckenbach
4,017,214 A 4/1977 Smith
4,066,425 A 1/1978 Nett
4,085,078 A 4/1978 McDonald
4,144,759 A 3/1979 Slowik
4,149,756 A 4/1979 Tackett
4,151,003 A 4/1979 Smith et al.
4,167,492 A 9/1979 Varady
4,176,052 A 11/1979 Bruce et al.
4,217,116 A 8/1980 Seever
4,260,068 A 4/1981 McCarthy et al.
4,299,687 A 11/1981 Myers et al.
4,302,324 A 11/1981 Chen et al.
4,308,968 A 1/1982 Thiltgen et al.
4,312,645 A 1/1982 Mavros
4,328,947 A 5/1982 Reimpell et al.
4,332,671 A 6/1982 Boyer
4,340,204 A 7/1982 Heard
4,353,812 A 10/1982 Lomas et al.
4,357,603 A 11/1982 Roach et al.
4,392,870 A 7/1983 Chieffo et al.
4,404,095 A 9/1983 Haddad et al.
4,422,925 A 12/1983 Williams et al.
4,434,044 A 2/1984 Busch et al.
4,439,533 A 3/1984 Lomas et al.
4,468,975 A 9/1984 Sayles et al.
4,482,451 A 11/1984 Kemp
4,495,063 A 1/1985 Walters et al.
4,539,012 A 9/1985 Ohzeki et al.
4,554,313 A 11/1985 Hagenbach et al.
4,554,799 A 11/1985 Pallanch
4,570,942 A 2/1986 Diehl et al.
4,583,859 A 4/1986 Hall, II
4,601,303 A 7/1986 Jensen
4,615,792 A 10/1986 Greenwood
4,621,062 A 11/1986 Stewart et al.
4,622,210 A 11/1986 Hirschberg et al.
4,624,771 A 11/1986 Lane et al.
4,647,313 A 3/1987 Clementoni
4,654,748 A 3/1987 Rees
4,661,241 A 4/1987 Dabkowski et al.
4,673,490 A 6/1987 Subramanian et al.
4,674,337 A 6/1987 Jonas
4,684,759 A 8/1987 Lam
4,686,027 A 8/1987 Bonilla et al.
4,728,348 A 3/1988 Nelson et al.
4,733,888 A 3/1988 Toelke
4,741,819 A 5/1988 Robinson et al.
4,764,347 A 8/1988 Milligan
4,765,631 A 8/1988 Kohnen et al.
4,771,176 A 9/1988 Scheifer et al.
4,816,137 A 3/1989 Swint et al.
4,820,404 A 4/1989 Owen
4,824,016 A 4/1989 Cody et al.
4,844,133 A 7/1989 von Meyerinck et al.
4,844,927 A 7/1989 Morris et al.
4,849,182 A 7/1989 Luetzelschwab
4,854,855 A 8/1989 Rajewski
4,875,994 A 10/1989 Haddad et al.
4,877,513 A 10/1989 Haire et al.
4,798,463 A 11/1989 Koshi
4,901,751 A 2/1990 Story et al.
4,914,249 A 4/1990 Benedict
4,916,938 A 4/1990 Aikin et al.
4,917,790 A 4/1990 Owen
4,923,834 A 5/1990 Lomas
4,940,900 A 7/1990 Lambert
4,957,511 A 9/1990 Ljusberg-Wahren
4,960,503 A 10/1990 Haun et al.
4,963,745 A 10/1990 Maggard
4,972,867 A 11/1990 Ruesch
5,000,841 A 3/1991 Owen
5,002,459 A 3/1991 Swearingen et al.
5,008,653 A 4/1991 Kidd et al.
5,009,768 A 4/1991 Galiasso et al.
5,013,537 A 5/1991 Patarin et al.
5,022,266 A 6/1991 Cody et al.
5,032,154 A 7/1991 Wright
5,034,115 A 7/1991 Avidan
5,045,177 A 9/1991 Cooper et al.
5,050,603 A 9/1991 Stokes et al.
5,053,371 A 10/1991 Williamson
5,056,758 A 10/1991 Bramblet
5,059,305 A 10/1991 Sapre
5,061,467 A 10/1991 Johnson et al.
5,066,049 A 11/1991 Staples
5,076,910 A 12/1991 Rush
5,082,985 A 1/1992 Crouzet et al.
5,096,566 A 3/1992 Dawson et al.
5,097,677 A 3/1992 Holtzapple
5,111,882 A 5/1992 Tang et al.
5,112,357 A 5/1992 Bjerklund
5,114,562 A 5/1992 Haun et al.
5,115,686 A 5/1992 Walker et al.
5,120,517 A 6/1992 Elshout
5,121,337 A 6/1992 Brown
5,128,109 A 7/1992 Owen
5,128,292 A 7/1992 Lomas

(56) References Cited

U.S. PATENT DOCUMENTS 5,129,624 A 7/1992 Icenhower et al.
5,138,891 A 8/1992 Johnson
5,139,649 A 8/1992 Owen et al.
5,145,785 A 9/1992 Maggard et al.
5,149,261 A 9/1992 Suwa et al.
5,154,558 A 10/1992 McCallion
5,160,426 A 11/1992 Avidan
5,170,911 A 12/1992 Della Riva
5,174,250 A 12/1992 Lane
5,174,345 A 12/1992 Kesterman et al.
5,178,363 A 1/1993 Icenhower et al.
5,196,110 A 3/1993 Swart et al.
5,201,850 A 4/1993 Lenhardt et al.
5,203,370 A 4/1993 Block et al.
5,211,838 A 5/1993 Staubs et al.
5,212,129 A 5/1993 Lomas
5,221,463 A 6/1993 Kamienski et al.
5,223,714 A 6/1993 Maggard
5,225,679 A 7/1993 Clark et al.
5,230,498 A 7/1993 Wood et al.
5,235,999 A 8/1993 Lindquist et al.
5,236,765 A 8/1993 Cordia et al.
5,243,546 A 9/1993 Maggard
5,246,860 A 9/1993 Hutchins et al.
5,246,868 A 9/1993 Busch et al.
5,248,408 A 9/1993 Owen
5,250,807 A 10/1993 Sontvedt
5,257,530 A 11/1993 Beattie et al.
5,258,115 A 11/1993 Heck et al.
5,258,117 A 11/1993 Kolstad et al.
5,262,645 A 11/1993 Lambert et al.
5,263,682 A 11/1993 Covert et al.
5,301,560 A 4/1994 Anderson et al.
5,302,294 A 4/1994 Schubert
5,316,448 A 5/1994 Ziegler et al.
5,320,671 A 6/1994 Schilling
5,326,074 A 7/1994 Spock et al.
5,328,505 A 7/1994 Schilling
5,328,591 A 7/1994 Raterman
5,332,492 A 7/1994 Maurer et al.
5,338,439 A 8/1994 Owen et al.
5,348,645 A 9/1994 Maggard et al.
5,349,188 A 9/1994 Maggard
5,349,189 A 9/1994 Maggard
5,354,451 A 10/1994 Goldstein et al.
5,354,453 A 10/1994 Bhatia
5,361,643 A 11/1994 Boyd et al.
5,362,965 A 11/1994 Maggard
5,370,146 A 12/1994 King et al.
5,370,790 A 12/1994 Maggard et al.
5,372,270 A 12/1994 Rosenkrantz
5,372,352 A 12/1994 Smith et al.
5,381,002 A 1/1995 Morrow et al.
5,388,805 A 2/1995 Bathrick et al.
5,389,232 A 2/1995 Adewuyi et al.
5,404,015 A 4/1995 Chimenti et al.
5,415,025 A 5/1995 Bartman et al.
5,416,323 A 5/1995 Hoots et al.
5,417,843 A 5/1995 Swart et al.
5,417,846 A 5/1995 Renard
5,423,446 A 6/1995 Johnson
5,431,067 A 7/1995 Anderson et al.
5,433,120 A 7/1995 Boyd et al.
5,435,436 A 7/1995 Manley et al.
5,443,716 A 8/1995 Anderson et al.
5,446,681 A 8/1995 Gethner et al.
5,452,232 A 9/1995 Espinosa et al.
RE35,046 E 10/1995 Hettinger et al.
5,459,677 A 10/1995 Kowalski et al.
5,472,875 A 12/1995 Monticello
5,474,607 A 12/1995 Holleran
5,475,612 A 12/1995 Espinosa et al.
5,476,117 A 12/1995 Pakula
5,490,085 A 2/1996 Lambert et al.
5,492,617 A 2/1996 Trimble et al.
5,494,079 A 2/1996 Tiedemann
5,507,326 A 4/1996 Cadman et al.
5,510,265 A 4/1996 Monticello
5,516,969 A 5/1996 Krasznai et al.
5,532,487 A 7/1996 Brearley et al.
5,540,893 A 7/1996 English
5,549,814 A 8/1996 Zinke
5,556,222 A 9/1996 Chen
5,559,295 A 9/1996 Sheryll
5,560,509 A 10/1996 Laverman et al.
5,569,808 A 10/1996 Cansell et al.
5,573,032 A 11/1996 Lenz et al.
5,584,985 A 12/1996 Lomas
5,596,196 A 1/1997 Cooper et al.
5,600,134 A 2/1997 Ashe et al.
5,647,961 A 7/1997 Lofland
5,652,145 A 7/1997 Cody et al.
5,675,071 A 10/1997 Cody et al.
5,681,749 A 10/1997 Ramamoorthy
5,684,580 A 11/1997 Cooper et al.
5,699,269 A 12/1997 Ashe et al.
5,699,270 A 12/1997 Ashe et al.
5,712,481 A 1/1998 Welch et al.
5,712,797 A 1/1998 Descales et al.
5,713,401 A 2/1998 Weeks
5,716,055 A 2/1998 Wilkinson et al.
5,717,209 A 2/1998 Bigman et al.
5,740,073 A 4/1998 Bages et al.
5,744,024 A 4/1998 Sullivan, III et al.
5,744,702 A 4/1998 Roussis et al.
5,746,906 A 5/1998 McHenry et al.
5,751,415 A 5/1998 Smith et al.
5,758,514 A 6/1998 Genung et al.
5,763,883 A 6/1998 Descales et al.
5,800,697 A 9/1998 Lengemann
5,817,517 A 10/1998 Perry et al.
5,822,058 A 10/1998 Adler-Golden et al.
5,834,539 A 11/1998 Krivohlavek
5,837,130 A 11/1998 Crossland
5,853,455 A 12/1998 Gibson
5,856,869 A 1/1999 Cooper et al.
5,858,207 A 1/1999 Lomas
5,858,210 A 1/1999 Richardson
5,858,212 A 1/1999 Darcy
5,861,228 A 1/1999 Descales et al.
5,862,060 A 1/1999 Murray, Jr.
5,865,441 A 2/1999 Orlowski
5,883,363 A 3/1999 Motoyoshi et al.
5,885,439 A 3/1999 Glover
5,892,228 A 4/1999 Cooper et al.
5,895,506 A 4/1999 Cook et al.
5,916,433 A 6/1999 Tejada et al.
5,919,354 A 7/1999 Bartek
5,935,415 A 8/1999 Haizmann et al.
5,940,176 A 8/1999 Knapp
5,972,171 A 10/1999 Ross et al.
5,979,491 A 11/1999 Gonsior
5,997,723 A 12/1999 Wiehe et al.
6,015,440 A 1/2000 Noureddini
6,025,305 A 2/2000 Aldrich et al.
6,026,841 A 2/2000 Kozik
6,040,186 A 3/2000 Lewis
6,047,602 A 4/2000 Lynnworth
6,056,005 A 5/2000 Piotrowski et al.
6,062,274 A 5/2000 Pettesch
6,063,263 A 5/2000 Palmas
6,063,265 A 5/2000 Chiyoda et al.
6,070,128 A 5/2000 Descales et al.
6,072,576 A 6/2000 McDonald et al.
6,076,864 A 6/2000 Levivier et al.
6,087,662 A 7/2000 Wilt et al.
6,093,867 A 7/2000 Ladwig et al.
6,099,607 A 8/2000 Haslebacher
6,099,616 A 8/2000 Jenne et al.
6,100,975 A 8/2000 Smith et al.
6,102,655 A 8/2000 Kreitmeier
6,105,441 A 8/2000 Conner et al.
6,107,631 A 8/2000 He
6,117,812 A 9/2000 Gao et al.

(56) References Cited

U.S. PATENT DOCUMENTS 6,130,095 A 10/2000 Shearer
6,140,647 A 10/2000 Welch et al.
6,153,091 A 11/2000 Sechrist et al.
6,155,294 A 12/2000 Cornford et al.
6,162,644 A 12/2000 Choi et al.
6,165,350 A 12/2000 Lokhandwala et al.
6,169,218 B1 1/2001 Hearn
6,171,052 B1 1/2001 Aschenbruck et al.
6,174,501 B1 1/2001 Noureddini
6,190,535 B1 2/2001 Kalnes et al.
6,203,585 B1 3/2001 Majerczak
6,235,104 B1 5/2001 Chattopadhyay et al.
6,258,987 B1 7/2001 Schmidt et al.
6,271,518 B1 8/2001 Boehm et al.
6,274,785 B1 8/2001 Gore
6,284,128 B1 9/2001 Glover et al.
6,296,812 B1 10/2001 Gauthier et al.
6,312,586 B1 11/2001 Kalnes et al.
6,315,815 B1 11/2001 Spadaccini
6,324,895 B1 12/2001 Chitnis et al.
6,328,348 B1 12/2001 Cornford et al.
6,331,436 B1 12/2001 Richardson et al.
6,348,074 B2 2/2002 Wenzel
6,350,371 B1 2/2002 Lokhandwala et al.
6,368,495 B1 4/2002 Kocal et al.
6,382,633 B1 5/2002 Hashiguchi et al.
6,390,673 B1 5/2002 Camburn
6,395,228 B1 5/2002 Maggard et al.
6,398,518 B1 6/2002 Ingistov
6,399,800 B1 6/2002 Haas et al.
6,420,181 B1 7/2002 Novak
6,422,035 B1 7/2002 Phillippe
6,435,279 B1 8/2002 Howe et al.
6,446,446 B1 9/2002 Cowans
6,446,729 B1 9/2002 Bixenman et al.
6,451,197 B1 9/2002 Kalnes
6,454,935 B1 9/2002 Lesieur et al.
6,467,303 B2 10/2002 Ross
6,482,762 B1 11/2002 Ruffin et al.
6,503,460 B1 1/2003 Miller et al.
6,528,047 B2 3/2003 Arif et al.
6,540,797 B1 4/2003 Scott et al.
6,558,531 B2 5/2003 Steffens et al.
6,589,323 B1 7/2003 Korin
6,592,448 B1 7/2003 Williams
6,609,888 B1 8/2003 Ingistov
6,622,490 B2 9/2003 Ingistov
6,644,935 B2 11/2003 Ingistov
6,660,895 B1 12/2003 Brunet et al.
6,672,858 B1 * 1/2004 Benson ..... F23C 9/08 431/9
6,733,232 B2 5/2004 Ingistov et al.
6,733,237 B2 5/2004 Ingistov
6,736,961 B2 5/2004 Plummer et al.
6,740,226 B2 5/2004 Mehra et al.
6,772,581 B2 8/2004 Ojiro et al.
6,772,741 B1 8/2004 Pittel et al.
6,814,941 B1 11/2004 Naunheimer et al.
6,824,673 B1 11/2004 Ellis et al.
6,827,841 B2 12/2004 Kiser et al.
6,835,223 B2 12/2004 Walker et al.
6,841,133 B2 1/2005 Niewiedzial et al.
6,842,702 B2 1/2005 Haaland et al.
6,854,346 B2 2/2005 Nimberger
6,858,128 B1 2/2005 Hoehn et al.
6,866,771 B2 3/2005 Lomas et al.
6,869,521 B2 3/2005 Lomas
6,897,071 B2 5/2005 Sonbul
6,962,484 B2 11/2005 Brandl et al.
7,013,718 B2 3/2006 Ingistov et al.
7,035,767 B2 4/2006 Archer et al.
7,048,254 B2 5/2006 Laurent et al.
7,074,321 B1 7/2006 Kalnes
7,078,005 B2 7/2006 Smith et al.
7,087,153 B1 8/2006 Kalnes
7,156,123 B2 1/2007 Welker et al.
7,172,686 B1 2/2007 Ji et al.
7,174,715 B2 2/2007 Armitage et al.
7,194,369 B2 3/2007 Lundstedt et al.
7,213,413 B2 5/2007 Battiste et al.
7,225,840 B1 6/2007 Craig et al.
7,228,250 B2 6/2007 Naiman et al.
7,244,350 B2 7/2007 Kar et al.
7,252,755 B2 8/2007 Kiser et al.
7,255,531 B2 8/2007 Ingistov
7,260,499 B2 8/2007 Watzke et al.
7,291,257 B2 11/2007 Ackerson et al.
7,332,132 B2 2/2008 Hedrick et al.
7,404,411 B2 7/2008 Welch et al.
7,419,583 B2 9/2008 Nieskens et al.
7,445,936 B2 11/2008 O'Connor et al.
7,459,081 B2 12/2008 Koenig
7,485,801 B1 2/2009 Pulter et al.
7,487,955 B1 2/2009 Buercklin
7,501,285 B1 3/2009 Triche et al.
7,551,420 B2 6/2009 Cerqueira et al.
7,571,765 B2 8/2009 Themig
7,637,970 B1 12/2009 Fox et al.
7,669,653 B2 3/2010 Craster et al.
7,682,501 B2 3/2010 Soni et al.
7,686,280 B2 3/2010 Lowery
7,857,964 B2 12/2010 Mashiko et al.
7,866,346 B1 1/2011 Walters
7,895,011 B2 2/2011 Youssefi et al.
7,914,601 B2 3/2011 Farr et al.
7,931,803 B2 4/2011 Buchanan
7,932,424 B2 4/2011 Fujimoto et al.
7,939,335 B1 5/2011 Triche et al.
7,981,361 B2 7/2011 Bacik
7,988,753 B1 8/2011 Fox et al.
7,993,514 B2 8/2011 Schlueter
8,007,662 B2 8/2011 Lomas et al.
8,017,910 B2 9/2011 Sharpe
8,029,662 B2 10/2011 Varma et al.
8,037,938 B2 10/2011 Jardim De Azevedo et al.
8,038,774 B2 10/2011 Peng
8,064,052 B2 11/2011 Feitisch et al.
8,066,867 B2 11/2011 Dziabala
8,080,426 B1 12/2011 Moore et al.
8,127,845 B2 3/2012 Assal
8,193,401 B2 6/2012 McGehee et al.
8,236,566 B2 8/2012 Carpenter et al.
8,286,673 B1 10/2012 Recker et al.
8,354,065 B1 1/2013 Sexton
8,360,118 B2 1/2013 Fleischer et al.
8,370,082 B2 2/2013 De Peinder et al.
8,388,830 B2 3/2013 Sohn et al.
8,389,285 B2 3/2013 Carpenter et al.
8,397,803 B2 3/2013 Crabb et al.
8,397,820 B2 3/2013 Fehr et al.
8,404,103 B2 3/2013 Dziabala
8,434,800 B1 5/2013 LeBlanc
8,481,942 B2 7/2013 Mertens
8,506,656 B1 8/2013 Turocy
8,518,131 B2 8/2013 Mattingly et al.
8,524,180 B2 9/2013 Canari et al.
8,569,068 B2 10/2013 Carpenter et al.
8,579,139 B1 11/2013 Sablak
8,591,814 B2 11/2013 Hodges
8,609,048 B1 12/2013 Beadle
8,647,415 B1 2/2014 De Haan et al.
8,670,945 B2 3/2014 van Schie
8,685,232 B2 4/2014 Mandal et al.
8,735,820 B2 5/2014 Mertens
8,753,502 B1 6/2014 Sexton et al.
8,764,970 B1 7/2014 Moore et al.
8,778,823 B1 7/2014 Oyekan et al.
8,781,757 B2 7/2014 Farquharson et al.
8,784,645 B2 7/2014 Iguchi et al.
8,829,258 B2 9/2014 Gong et al.
8,916,041 B2 12/2014 Van Den Berg et al.
8,932,458 B1 1/2015 Gianzon et al.
8,986,402 B2 3/2015 Kelly
8,987,537 B1 3/2015 Droubi et al.

(56) References Cited

U.S. PATENT DOCUMENTS

| | | | |
|---|---|---|---|
| 8,999,011 | B2 | 4/2015 | Stern et al. |
| 8,999,012 | B2 | 4/2015 | Kelly et al. |
| 9,011,674 | B2 | 4/2015 | Milam et al. |
| 9,057,035 | B1 | 6/2015 | Kraus et al. |
| 9,097,423 | B2 | 8/2015 | Kraus et al. |
| 9,109,176 | B2 | 8/2015 | Stern et al. |
| 9,109,177 | B2 | 8/2015 | Freel et al. |
| 9,138,738 | B1 | 9/2015 | Glover et al. |
| 9,216,376 | B2 | 12/2015 | Liu et al. |
| 9,272,241 | B2 | 3/2016 | Königsson |
| 9,273,867 | B2 | 3/2016 | Buzinski et al. |
| 9,279,748 | B1 | 3/2016 | Hughes et al. |
| 9,289,715 | B2 | 3/2016 | Høy-Petersen et al. |
| 9,315,403 | B1 | 4/2016 | Laur et al. |
| 9,371,493 | B1 | 6/2016 | Oyekan |
| 9,371,494 | B2 | 6/2016 | Oyekan et al. |
| 9,377,340 | B2 | 6/2016 | Hägg |
| 9,393,520 | B2 | 7/2016 | Gomez |
| 9,410,102 | B2 | 8/2016 | Eaton et al. |
| 9,428,695 | B2 | 8/2016 | Narayanaswamy et al. |
| 9,453,169 | B2 | 9/2016 | Stippich, Jr. et al. |
| 9,458,396 | B2 | 10/2016 | Weiss et al. |
| 9,487,718 | B2 | 11/2016 | Kraus et al. |
| 9,499,758 | B2 | 11/2016 | Droubi et al. |
| 9,500,300 | B2 | 11/2016 | Daigle |
| 9,506,649 | B2 | 11/2016 | Rennie et al. |
| 9,580,662 | B1 | 2/2017 | Moore |
| 9,624,448 | B2 | 4/2017 | Joo et al. |
| 9,650,580 | B2 | 5/2017 | Merdrignac et al. |
| 9,657,241 | B2 | 5/2017 | Craig et al. |
| 9,662,597 | B1 | 5/2017 | Formoso |
| 9,663,729 | B2 | 5/2017 | Baird et al. |
| 9,665,693 | B2 | 5/2017 | Saeger et al. |
| 9,709,545 | B2 | 7/2017 | Mertens |
| 9,757,686 | B2 | 9/2017 | Peng |
| 9,789,290 | B2 | 10/2017 | Forsell |
| 9,803,152 | B2 | 10/2017 | Kar et al. |
| 9,834,731 | B2 | 12/2017 | Weiss et al. |
| 9,840,674 | B2 | 12/2017 | Weiss et al. |
| 9,873,080 | B2 | 1/2018 | Richardson |
| 9,878,300 | B2 | 1/2018 | Norling |
| 9,890,907 | B1 | 2/2018 | Highfield et al. |
| 9,891,198 | B2 | 2/2018 | Sutan |
| 9,895,649 | B2 | 2/2018 | Brown et al. |
| 9,896,630 | B2 | 2/2018 | Weiss et al. |
| 9,914,094 | B2 | 3/2018 | Jenkins et al. |
| 9,920,270 | B2 | 3/2018 | Robinson et al. |
| 9,925,486 | B1 | 3/2018 | Botti |
| 9,982,788 | B1 | 5/2018 | Maron |
| 9,988,585 | B2 | 6/2018 | Hayasaka et al. |
| 10,047,299 | B2 | 8/2018 | Rubin-Pitel et al. |
| 10,048,100 | B1 | 8/2018 | Workman, Jr. |
| 10,087,397 | B2 | 10/2018 | Phillips et al. |
| 10,099,175 | B2 | 10/2018 | Takashashi et al. |
| 10,150,078 | B2 | 12/2018 | Komatsu et al. |
| 10,228,708 | B2 | 3/2019 | Lambert et al. |
| 10,239,034 | B1 | 3/2019 | Sexton |
| 10,253,269 | B2 | 4/2019 | Cantley et al. |
| 10,266,779 | B2 | 4/2019 | Weiss et al. |
| 10,295,521 | B2 | 5/2019 | Mertens |
| 10,308,884 | B2 | 6/2019 | Klussman |
| 10,316,263 | B2 | 6/2019 | Rubin-Pitel et al. |
| 10,384,157 | B2 | 8/2019 | Balcik |
| 10,435,339 | B2 | 10/2019 | Larsen et al. |
| 10,435,636 | B2 | 10/2019 | Johnson et al. |
| 10,443,000 | B2 | 10/2019 | Lomas |
| 10,443,006 | B1 | 10/2019 | Fruchey et al. |
| 10,457,881 | B2 | 10/2019 | Droubi et al. |
| 10,479,943 | B1 | 11/2019 | Liu et al. |
| 10,494,579 | B2 | 12/2019 | Wrigley et al. |
| 10,495,570 | B2 | 12/2019 | Owen et al. |
| 10,501,699 | B2 | 12/2019 | Robinson et al. |
| 10,526,547 | B2 | 1/2020 | Larsen et al. |
| 10,533,141 | B2 | 1/2020 | Moore et al. |
| 10,563,130 | B2 | 2/2020 | Narayanaswamy et al. |
| 10,563,132 | B2 | 2/2020 | Moore et al. |
| 10,563,133 | B2 | 2/2020 | Moore et al. |
| 10,570,078 | B2 | 2/2020 | Larsen et al. |
| 10,577,551 | B2 | 3/2020 | Kraus et al. |
| 10,584,287 | B2 | 3/2020 | Klussman et al. |
| 10,604,709 | B2 | 3/2020 | Moore et al. |
| 10,640,719 | B2 | 5/2020 | Freel et al. |
| 10,655,074 | B2 | 5/2020 | Moore et al. |
| 10,696,906 | B2 | 6/2020 | Cantley et al. |
| 10,808,184 | B1 | 10/2020 | Moore |
| 10,836,966 | B2 | 11/2020 | Moore et al. |
| 10,876,053 | B2 | 12/2020 | Klussman et al. |
| 10,954,456 | B2 | 3/2021 | Moore et al. |
| 10,961,468 | B2 | 3/2021 | Moore et al. |
| 10,962,259 | B2 | 3/2021 | Shah et al. |
| 10,968,403 | B2 | 4/2021 | Moore |
| 11,021,662 | B2 | 6/2021 | Moore et al. |
| 11,098,255 | B2 | 8/2021 | Larsen et al. |
| 11,124,714 | B2 | 9/2021 | Eller et al. |
| 11,136,513 | B2 | 10/2021 | Moore et al. |
| 11,164,406 | B2 | 11/2021 | Meroux et al. |
| 11,168,270 | B1 | 11/2021 | Moore |
| 11,175,039 | B2 | 11/2021 | Lochschmied et al. |
| 11,203,719 | B2 | 12/2021 | Cantley et al. |
| 11,203,722 | B2 | 12/2021 | Moore et al. |
| 11,214,741 | B2 | 1/2022 | Davdov et al. |
| 11,306,253 | B2 | 4/2022 | Timken et al. |
| 11,319,262 | B2 | 5/2022 | Wu et al. |
| 11,352,577 | B2 | 6/2022 | Woodchick et al. |
| 11,352,578 | B2 | 6/2022 | Eller et al. |
| 11,384,301 | B2 | 7/2022 | Eller et al. |
| 11,421,162 | B2 | 8/2022 | Pradeep et al. |
| 11,460,478 | B2 | 10/2022 | Sugiyama et al. |
| 11,467,172 | B1 | 10/2022 | Mitzel et al. |
| 11,542,441 | B2 | 1/2023 | Larsen et al. |
| 11,578,638 | B2 | 2/2023 | Thobe |
| 11,634,647 | B2 | 4/2023 | Cantley et al. |
| 11,667,858 | B2 | 6/2023 | Eller et al. |
| 11,692,141 | B2 | 7/2023 | Larsen et al. |
| 11,702,600 | B2 | 7/2023 | Sexton et al. |
| 11,715,950 | B2 | 8/2023 | Miller et al. |
| 11,720,526 | B2 | 8/2023 | Miller et al. |
| 11,802,257 | B2 | 10/2023 | Short et al. |
| 11,835,450 | B2 | 12/2023 | Bledsoe, Jr. et al. |
| 11,860,069 | B2 | 1/2024 | Bledsoe, Jr. |
| 11,891,581 | B2 | 2/2024 | Cantley et al. |
| 11,898,109 | B2 | 2/2024 | Sexton et al. |
| 11,905,468 | B2 | 2/2024 | Sexton et al. |
| 11,905,479 | B2 | 2/2024 | Eller et al. |
| 11,906,423 | B2 | 2/2024 | Bledsoe, Jr. et al. |
| 11,920,096 | B2 | 3/2024 | Woodchick et al. |
| 11,921,035 | B2 | 3/2024 | Bledsoe, Jr. et al. |
| 11,970,664 | B2 | 4/2024 | Larsen |
| 11,975,316 | B2 | 5/2024 | Zalewski |
| 12,000,720 | B2 | 6/2024 | Langlois, III |
| 12,018,216 | B2 | 6/2024 | Larsen et al. |
| 12,031,094 | B2 | 7/2024 | Sexton et al. |
| 12,031,676 | B2 | 7/2024 | Craig et al. |
| 12,037,548 | B2 | 7/2024 | Larsen et al. |
| 12,163,878 | B2 | 12/2024 | Bledsoe, Jr. |
| 2002/0014068 | A1 | 2/2002 | Mittricker et al. |
| 2002/0061633 | A1 | 5/2002 | Marsh |
| 2002/0170431 | A1 | 11/2002 | Chang et al. |
| 2003/0041518 | A1 | 3/2003 | Wallace et al. |
| 2003/0113598 | A1 | 6/2003 | Chow et al. |
| 2003/0188536 | A1 | 10/2003 | Mittricker |
| 2003/0194322 | A1 | 10/2003 | Brandl et al. |
| 2004/0010170 | A1 | 1/2004 | Vickers |
| 2004/0033617 | A1 | 2/2004 | Sonbul |
| 2004/0040201 | A1 | 3/2004 | Roos et al. |
| 2004/0079431 | A1 | 4/2004 | Kissell |
| 2004/0121472 | A1 | 6/2004 | Nemana et al. |
| 2004/0129605 | A1 | 7/2004 | Goldstein et al. |
| 2004/0139858 | A1 | 7/2004 | Entezarian |
| 2004/0154610 | A1 | 8/2004 | Hopp et al. |
| 2004/0232050 | A1 | 11/2004 | Martin et al. |
| 2004/0251170 | A1 | 12/2004 | Chiyoda et al. |
| 2005/0042151 | A1 | 2/2005 | Alward et al. |
| 2005/0088653 | A1 | 4/2005 | Coates et al. |

(56) References Cited

U.S. PATENT DOCUMENTS

2005/0123466 A1 6/2005 Sullivan
2005/0139516 A1 6/2005 Nieskens et al.
2005/0143609 A1 6/2005 Wolf et al.
2005/0150820 A1 7/2005 Guo
2005/0216214 A1 9/2005 Gorin
2005/0229777 A1 10/2005 Brown
2006/0037237 A1 2/2006 Copeland et al.
2006/0042701 A1 3/2006 Jansen
2006/0049082 A1 3/2006 Niccum et al.
2006/0091059 A1 5/2006 Barbaro
2006/0162243 A1 7/2006 Wolf
2006/0169305 A1 8/2006 Jansen et al.
2006/0210456 A1 9/2006 Bruggendick
2006/0169064 A1 10/2006 Anschutz et al.
2006/0220383 A1 10/2006 Erickson
2007/0003450 A1 1/2007 Burdett et al.
2007/0082407 A1 4/2007 Little, III
2007/0112258 A1 5/2007 Soyemi et al.
2007/0202027 A1 8/2007 Walker et al.
2007/0212271 A1 9/2007 Kennedy et al.
2007/0212790 A1 9/2007 Welch et al.
2007/0215521 A1 9/2007 Havlik et al.
2007/0243556 A1 10/2007 Wachs
2007/0283812 A1 12/2007 Liu et al.
2008/0078693 A1 4/2008 Sexton et al.
2008/0078694 A1 4/2008 Sexton et al.
2008/0078695 A1 4/2008 Sexton et al.
2008/0081844 A1 4/2008 Shires et al.
2008/0087592 A1 4/2008 Buchanan
2008/0092436 A1 4/2008 Seames et al.
2008/0109107 A1 5/2008 Stefani et al.
2008/0149486 A1 6/2008 Greaney et al.
2008/0156696 A1 7/2008 Niccum et al.
2008/0207974 A1 8/2008 McCoy et al.
2008/0211505 A1 9/2008 Trygstad et al.
2008/0247942 A1 10/2008 Kandziora et al.
2008/0253936 A1 10/2008 Abhari
2009/0151250 A1 6/2009 Agrawal
2009/0152454 A1 6/2009 Nelson et al.
2009/0158824 A1 6/2009 Brown et al.
2010/0127217 A1 5/2010 Lightowlers et al.
2010/0131247 A1 5/2010 Carpenter et al.
2010/0166602 A1 7/2010 Bacik
2010/0243235 A1 9/2010 Caldwell et al.
2010/0301044 A1 12/2010 Sprecher
2010/0318118 A1 12/2010 Forsell
2011/0147267 A1 6/2011 Kaul et al.
2011/0155646 A1 6/2011 Karas et al.
2011/0175032 A1 7/2011 Günther
2011/0186307 A1 8/2011 Derby
2011/0220586 A1 9/2011 Levitt
2011/0237856 A1 9/2011 Mak
2011/0247835 A1 10/2011 Crabb
2011/0277377 A1 11/2011 Novak et al.
2011/0299076 A1 12/2011 Feitisch et al.
2011/0319698 A1 12/2011 Sohn et al.
2012/0012342 A1 1/2012 Wilkin et al.
2012/0125813 A1 5/2012 Bridges et al.
2012/0125814 A1 5/2012 Sanchez et al.
2012/0131853 A1 5/2012 Thacker et al.
2012/0222550 A1 9/2012 Ellis
2012/0272715 A1 11/2012 Kriel et al.
2013/0014431 A1 1/2013 Jin et al.
2013/0109895 A1 5/2013 Novak et al.
2013/0112313 A1 5/2013 Donnelly et al.
2013/0125619 A1 5/2013 Wang
2013/0186739 A1 7/2013 Trompiz
2013/0192339 A1 8/2013 Kriel et al.
2013/0225897 A1 8/2013 Candelon et al.
2013/0288355 A1 10/2013 DeWitte et al.
2013/0302738 A1* 11/2013 Rennie ..... F23N 1/022 431/12
2013/0334027 A1 12/2013 Winter et al.
2013/0342203 A1 12/2013 Trygstad et al.
2014/0019052 A1 1/2014 Zaeper et al.
2014/0024873 A1 1/2014 De Haan et al.
2014/0041150 A1 2/2014 Sjoberg
2014/0121428 A1 5/2014 Wang et al.
2014/0229010 A1 8/2014 Farquharson et al.
2014/0251129 A1 9/2014 Upadhyay
2014/0296057 A1 10/2014 Ho et al.
2014/0299515 A1 10/2014 Weiss et al.
2014/0311953 A1 10/2014 Chimenti et al.
2014/0316176 A1 10/2014 Fjare et al.
2014/0332444 A1 11/2014 Weiss et al.
2014/0353138 A1 12/2014 Amale et al.
2014/0374322 A1 12/2014 Venkatesh
2015/0005547 A1 1/2015 Freel et al.
2015/0005548 A1 1/2015 Freel et al.
2015/0007720 A1 1/2015 Vu
2015/0034570 A1 2/2015 Andreussi
2015/0034599 A1 2/2015 Hunger et al.
2015/0057477 A1 2/2015 Ellig et al.
2015/0071028 A1 3/2015 Glanville
2015/0122704 A1 5/2015 Kumar et al.
2015/0166426 A1 6/2015 Wegerer et al.
2015/0240167 A1 8/2015 Kulprathipanja et al.
2015/0240174 A1 8/2015 Bru et al.
2015/0337207 A1 11/2015 Chen et al.
2015/0337225 A1 11/2015 Droubi et al.
2015/0337226 A1 11/2015 Tardif et al.
2015/0353851 A1 12/2015 Buchanan
2016/0045918 A1 2/2016 Lapham
2016/0090539 A1 3/2016 Frey et al.
2016/0122662 A1 5/2016 Weiss et al.
2016/0122666 A1 5/2016 Weiss et al.
2016/0160139 A1 6/2016 Dawe et al.
2016/0168481 A1 6/2016 Ray et al.
2016/0175749 A1 6/2016 Suda
2016/0244677 A1 8/2016 Froehle
2016/0298851 A1 10/2016 Brickwood et al.
2016/0312127 A1 10/2016 Frey et al.
2016/0312130 A1 10/2016 Majcher et al.
2017/0009163 A1 1/2017 Kraus et al.
2017/0115190 A1 4/2017 Hall et al.
2017/0128859 A1 5/2017 Levitt
2017/0131728 A1 5/2017 Lambert et al.
2017/0151526 A1 6/2017 Cole
2017/0183575 A1 6/2017 Rubin-Pitel et al.
2017/0198910 A1* 7/2017 Garg ..... F23L 13/08
2017/0226434 A1 8/2017 Zimmerman
2017/0233670 A1 8/2017 Feustel et al.
2017/0234335 A1 8/2017 LeBlanc et al.
2017/0269559 A1 9/2017 Trygstad
2018/0017469 A1 1/2018 English et al.
2018/0037308 A1 2/2018 Lee et al.
2018/0080958 A1 3/2018 Marchese et al.
2018/0094809 A1* 4/2018 Lochschmied ..... F23N 1/027
2018/0119039 A1 5/2018 Tanaka et al.
2018/0134974 A1 5/2018 Weiss et al.
2018/0163144 A1 6/2018 Weiss et al.
2018/0179457 A1 6/2018 Mukherjee et al.
2018/0202607 A1 7/2018 McBride
2018/0230389 A1 8/2018 Moore et al.
2018/0246142 A1 8/2018 Glover
2018/0355263 A1 12/2018 Moore et al.
2018/0361312 A1 12/2018 Dutra e Mello et al.
2018/0371325 A1 12/2018 Streiff et al.
2019/0002772 A1 1/2019 Moore et al.
2019/0010405 A1 1/2019 Moore et al.
2019/0010408 A1 1/2019 Moore et al.
2019/0016980 A1 1/2019 Kar et al.
2019/0093026 A1 3/2019 Wohaibi et al.
2019/0099706 A1 4/2019 Sampath
2019/0100702 A1 4/2019 Cantley et al.
2019/0127651 A1 5/2019 Kar et al.
2019/0128160 A1 5/2019 Peng
2019/0136144 A1 5/2019 Wohaibi et al.
2019/0153340 A1 5/2019 Weiss et al.
2019/0153942 A1 5/2019 Wohaibi et al.
2019/0169509 A1 6/2019 Cantley et al.
2019/0185772 A1 6/2019 Berkhous et al.
2019/0201841 A1 7/2019 McClelland
2019/0203130 A1 7/2019 Mukherjee

(56) References Cited

U.S. PATENT DOCUMENTS

| | | | |
|---|---|---|---|
| 2019/0218466 | A1 | 7/2019 | Slade et al. |
| 2019/0233741 | A1 | 8/2019 | Moore et al. |
| 2019/0292465 | A1 | 9/2019 | McBride |
| 2019/0338205 | A1 | 11/2019 | Ackerson et al. |
| 2019/0382668 | A1 | 12/2019 | Klussman et al. |
| 2019/0382672 | A1 | 12/2019 | Sorensen |
| 2020/0041481 | A1 | 2/2020 | Burgess |
| 2020/0049675 | A1 | 2/2020 | Ramirez |
| 2020/0080881 | A1 | 3/2020 | Langlois et al. |
| 2020/0095509 | A1 | 3/2020 | Moore et al. |
| 2020/0123458 | A1 | 4/2020 | Moore et al. |
| 2020/0181502 | A1 | 6/2020 | Paasikallio et al. |
| 2020/0191385 | A1* | 6/2020 | Carroll ..... F23D 14/02 |
| 2020/0199462 | A1 | 6/2020 | Klussman et al. |
| 2020/0208068 | A1 | 7/2020 | Hossain et al. |
| 2020/0246743 | A1 | 8/2020 | Sorensen |
| 2020/0291316 | A1 | 9/2020 | Robbins et al. |
| 2020/0312470 | A1 | 10/2020 | Craig et al. |
| 2020/0316513 | A1 | 10/2020 | Zhao |
| 2020/0332198 | A1 | 10/2020 | Yang et al. |
| 2020/0353456 | A1 | 11/2020 | Zalewski et al. |
| 2020/0378600 | A1 | 12/2020 | Craig et al. |
| 2020/0385644 | A1 | 12/2020 | Rogel et al. |
| 2021/0002559 | A1 | 1/2021 | Larsen et al. |
| 2021/0003502 | A1 | 1/2021 | Kirchmann et al. |
| 2021/0033631 | A1 | 2/2021 | Field et al. |
| 2021/0103304 | A1 | 4/2021 | Fogarty et al. |
| 2021/0115344 | A1 | 4/2021 | Perkins et al. |
| 2021/0181164 | A1 | 6/2021 | Shirkhan et al. |
| 2021/0213382 | A1 | 7/2021 | Cole |
| 2021/0238487 | A1 | 8/2021 | Moore et al. |
| 2021/0253964 | A1 | 8/2021 | Eller et al. |
| 2021/0253965 | A1 | 8/2021 | Woodchick et al. |
| 2021/0261874 | A1 | 8/2021 | Eller et al. |
| 2021/0284919 | A1 | 9/2021 | Moore et al. |
| 2021/0292661 | A1 | 9/2021 | Klussman et al. |
| 2021/0301210 | A1 | 9/2021 | Timken et al. |
| 2021/0318280 | A1 | 10/2021 | Ludlum |
| 2021/0396660 | A1 | 12/2021 | Zarrabian |
| 2021/0403819 | A1 | 12/2021 | Moore et al. |
| 2022/0040629 | A1 | 2/2022 | Edmoundson et al. |
| 2022/0041939 | A1 | 2/2022 | Titta et al. |
| 2022/0041940 | A1 | 2/2022 | Pradeep et al. |
| 2022/0048019 | A1 | 2/2022 | Zalewski et al. |
| 2022/0268694 | A1 | 8/2022 | Bledsoe et al. |
| 2022/0298440 | A1 | 9/2022 | Woodchick et al. |
| 2022/0299170 | A1 | 9/2022 | Raynor et al. |
| 2022/0343229 | A1 | 10/2022 | Gruber et al. |
| 2022/0357303 | A1 | 11/2022 | Zhu et al. |
| 2023/0015077 | A1 | 1/2023 | Kim |
| 2023/0078852 | A1 | 3/2023 | Campbell et al. |
| 2023/0080192 | A1 | 3/2023 | Bledsoe et al. |
| 2023/0082189 | A1 | 3/2023 | Bledsoe et al. |
| 2023/0084329 | A1 | 3/2023 | Bledsoe et al. |
| 2023/0087063 | A1 | 3/2023 | Mitzel et al. |
| 2023/0089935 | A1 | 3/2023 | Bledsoe et al. |
| 2023/0093452 | A1 | 3/2023 | Sexton et al. |
| 2023/0111609 | A1 | 4/2023 | Sexton et al. |
| 2023/0113140 | A1 | 4/2023 | Larsen et al. |
| 2023/0118319 | A1 | 4/2023 | Sexton et al. |
| 2023/0220286 | A1 | 7/2023 | Cantley et al. |
| 2023/0241548 | A1 | 8/2023 | Holland et al. |
| 2023/0242837 | A1 | 8/2023 | Short et al. |
| 2023/0259080 | A1 | 8/2023 | Whikehart et al. |
| 2023/0259088 | A1 | 8/2023 | Borup et al. |
| 2023/0272290 | A1 | 8/2023 | Larsen et al. |
| 2023/0295528 | A1 | 9/2023 | Eller et al. |
| 2023/0332056 | A1 | 10/2023 | Larsen et al. |
| 2023/0332058 | A1 | 10/2023 | Larsen et al. |
| 2023/0357649 | A1 | 11/2023 | Sexton et al. |
| 2023/0416615 | A1 | 12/2023 | Larsen |
| 2023/0416638 | A1 | 12/2023 | Short |
| 2024/0011898 | A1 | 1/2024 | Bledsoe, Jr. et al. |
| 2024/0115996 | A1 | 4/2024 | Rudd |
| 2024/0117262 | A1 | 4/2024 | Eller |
| 2024/0118194 | A1 | 4/2024 | Bledsoe, Jr. |
| 2024/0124790 | A1 | 4/2024 | Sexton |
| 2024/0132786 | A1 | 4/2024 | Sexton |
| 2024/0182803 | A1 | 6/2024 | Woodchick |
| 2024/0189753 | A1 | 6/2024 | Esquivel |
| 2024/0294837 | A1 | 9/2024 | Larsen |
| 2024/0327723 | A1 | 10/2024 | Larsen |
| 2024/0337352 | A1 | 10/2024 | Craig |
| 2024/0377287 | A1 | 11/2024 | Markins |
| 2024/0399279 | A1 | 12/2024 | Duong |

FOREIGN PATENT DOCUMENTS

| | | |
|---|---|---|
| CA | 2949201 | 11/2015 |
| CA | 2822742 | 12/2016 |
| CA | 3009808 | 7/2017 |
| CA | 2904903 | 8/2020 |
| CA | 3077045 | 9/2020 |
| CA | 2947431 | 3/2021 |
| CA | 3004712 | 6/2021 |
| CA | 2980055 | 12/2021 |
| CA | 2879783 | 1/2022 |
| CA | 2991614 | 1/2022 |
| CA | 2980069 | 11/2022 |
| CA | 3109606 | 12/2022 |
| CH | 432129 | 3/1967 |
| CN | 2128346 | 3/1993 |
| CN | 201264907 Y | 7/2009 |
| CN | 201306736 | 9/2009 |
| CN | 201940168 | 8/2011 |
| CN | 102120138 | 12/2012 |
| CN | 203453713 | 2/2014 |
| CN | 103627433 | 3/2014 |
| CN | 203629938 | 6/2014 |
| CN | 203816490 | 9/2014 |
| CN | 104353357 | 2/2015 |
| CN | 204170623 | 2/2015 |
| CN | 103331093 | 4/2015 |
| CN | 204253221 | 4/2015 |
| CN | 204265565 | 4/2015 |
| CN | 105148728 | 12/2015 |
| CN | 204824775 | 12/2015 |
| CN | 103933845 | 1/2016 |
| CN | 105289241 | 2/2016 |
| CN | 105536486 | 5/2016 |
| CN | 105804900 | 7/2016 |
| CN | 103573430 | 8/2016 |
| CN | 205655095 | 10/2016 |
| CN | 104326604 | 11/2016 |
| CN | 104358627 | 11/2016 |
| CN | 106237802 | 12/2016 |
| CN | 205779365 | 12/2016 |
| CN | 106407648 | 2/2017 |
| CN | 105778987 | 8/2017 |
| CN | 207179722 | 4/2018 |
| CN | 207395575 | 5/2018 |
| CN | 108179022 | 6/2018 |
| CN | 108704478 | 10/2018 |
| CN | 109126458 | 1/2019 |
| CN | 109423345 | 3/2019 |
| CN | 109499365 | 3/2019 |
| CN | 109705939 | 5/2019 |
| CN | 109722303 | 5/2019 |
| CN | 110129103 | 8/2019 |
| CN | 110229686 | 9/2019 |
| CN | 209451617 | 10/2019 |
| CN | 110987862 | 4/2020 |
| CN | 111336612 A | 6/2020 |
| CN | 213762571 U | 7/2021 |
| CN | 213824075 U | 7/2021 |
| CN | 215263512 U | 12/2021 |
| CN | 215288592 | 12/2021 |
| CN | 113963818 | 1/2022 |
| CN | 114001278 | 2/2022 |
| CN | 217431673 | 9/2022 |
| CN | 218565442 | 3/2023 |
| DE | 10179 | 6/1912 |
| DE | 3721725 | 1/1989 |
| DE | 19619722 | 11/1997 |

(56) References Cited

FOREIGN PATENT DOCUMENTS

| | | | |
|---|---|---|---|
| DE | 102010017563 | | 12/2011 |
| DE | 102014009231 | A1 | 1/2016 |
| EP | 0142352 | | 5/1985 |
| EP | 0527000 | | 2/1993 |
| EP | 0783910 | A1 | 7/1997 |
| EP | 0949318 | | 10/1999 |
| EP | 0783910 | B1 | 12/2000 |
| EP | 0801299 | | 3/2004 |
| EP | 1413712 | | 4/2004 |
| EP | 1600491 | | 11/2005 |
| EP | 1870153 | | 12/2007 |
| EP | 2047905 | | 4/2009 |
| EP | 2955345 | | 12/2015 |
| EP | 3130773 | | 2/2017 |
| EP | 3139009 | | 3/2017 |
| EP | 3239483 | | 11/2017 |
| EP | 3085910 | | 8/2018 |
| EP | 3355056 | | 8/2018 |
| EP | 2998529 | | 2/2019 |
| EP | 3441442 | | 2/2019 |
| EP | 3569988 | | 11/2019 |
| EP | 3878926 | | 9/2021 |
| FR | 2357630 | | 2/1978 |
| FR | 3004722 | | 3/2016 |
| FR | 3027909 | | 5/2016 |
| FR | 3067036 | | 12/2018 |
| FR | 3067037 | | 12/2018 |
| FR | 3072684 | | 4/2019 |
| FR | 3075808 | | 6/2019 |
| GB | 775273 | | 5/1957 |
| GB | 933618 | | 8/1963 |
| GB | 1207719 | | 10/1970 |
| GB | 2144526 | | 3/1985 |
| GB | 2516441 | | 1/2015 |
| IN | 202111016535 | | 7/2021 |
| JP | 59220609 | | 12/1984 |
| JP | 2003129067 | | 5/2003 |
| JP | 2005147478 | A | 6/2005 |
| JP | 3160405 | | 6/2010 |
| JP | 2015059220 | | 3/2015 |
| JP | 2019014275 | | 1/2019 |
| KR | 101751923 | | 7/2017 |
| KR | 101823897 | | 3/2018 |
| KR | 20180095303 | | 8/2018 |
| KR | 20190004474 | | 1/2019 |
| KR | 20190004475 | | 1/2019 |
| RU | 2673558 | | 11/2018 |
| RU | 2700705 | | 9/2019 |
| RU | 2760879 | | 12/2021 |
| TW | 320682 | | 11/1997 |
| WO | 94/08225 | | 4/1994 |
| WO | 199640436 | | 12/1996 |
| WO | 1997033678 | | 9/1997 |
| WO | 199803249 | | 1/1998 |
| WO | 1999041591 | | 8/1999 |
| WO | 2001051588 | | 7/2001 |
| WO | 2002038295 | | 5/2002 |
| WO | 2006126978 | | 11/2006 |
| WO | 2008088294 | | 7/2008 |
| WO | 2010/144191 | | 12/2010 |
| WO | 2012026302 | | 3/2012 |
| WO | 2012062924 | | 5/2012 |
| WO | 2012089776 | | 7/2012 |
| WO | 2012108584 | | 8/2012 |
| WO | 2014053431 | | 4/2014 |
| WO | 2014096703 | | 6/2014 |
| WO | 2014096704 | | 6/2014 |
| WO | 2014191004 | | 7/2014 |
| WO | 2014177424 | | 11/2014 |
| WO | 2014202815 | | 12/2014 |
| WO | 2016167708 | | 10/2016 |
| WO | 2017067088 | | 4/2017 |
| WO | 2017207976 | | 12/2017 |
| WO | 2018017664 | | 1/2018 |
| WO | 2018073018 | | 4/2018 |
| WO | 2018122274 | | 7/2018 |
| WO | 2018148675 | | 8/2018 |
| WO | 2018148681 | | 8/2018 |
| WO | 2018231105 | | 12/2018 |
| WO | 2019053323 | | 3/2019 |
| WO | 2019104243 | | 5/2019 |
| WO | 2019155183 | | 8/2019 |
| WO | 2019178701 | | 9/2019 |
| WO | 2020035797 | | 2/2020 |
| WO | 2020160004 | | 8/2020 |
| WO | 2021058289 | | 4/2021 |
| WO | 2022133359 | | 6/2022 |
| WO | 2022144495 | | 7/2022 |
| WO | 2022149501 | | 7/2022 |
| WO | 2022219234 | | 10/2022 |
| WO | 2022220991 | | 10/2022 |
| WO | 2023020797 | | 2/2023 |
| WO | 2023038579 | | 3/2023 |
| WO | 2023137304 | | 7/2023 |
| WO | 2023164683 | | 8/2023 |
| WO | 2023242308 | | 12/2023 |

OTHER PUBLICATIONS

Cremer et al., Model Based Assessment of the Novel Use of Sour Water Stripper Vapor for NOx Control in CO Boilers, Industrial Combustion Symposium, American Flame Research Committee 2021, Nov. 19, 2021.

Frederick et al., Alternative Technology for Sour Water Stripping, University of Pennsylvania, Penn Libraries, Scholarly Commons, Apr. 20, 2018.

Da Vinci Laboratory Solutions B. V., DVLS Liquefied Gas Injector, Sampling and analysis of liquefied gases, https://www.davinci-ls.com/en/products/dvls-products/dvls-liquefied-gas-injector.

Wasson ECE Instrumentation, LPG Pressurization Station, https://wasson-ece.com/products/small-devices/lpg-pressurization-station.

Mechatest B. V., Gas & Liquefied Gas Sampling Systems, https://www.mechatest.com/products/gas-sampling-system/.

La Rivista dei Combustibili, The Fuel Magazine, vol. 66, File 2, 2012.

Zulkefi et al., Overview of H2S Removal Technologies from Biogas Production, International Journal of Applied Engineering Research ISSN 0973-4562, vol. 11, No. 20, pp. 10060-10066, © Research India Publications, 2016.

Seo et al., Methanol absorption characteristics for the removal of H2S (hydrogen sulfide), COS (carbonyl sulfide) and CO2 (carbon dioxide) in a pilot-scale biomass-to-liquid process, Energy 66, pp. 56-62, 2014.

Pashikanti et al., "Predictive modeling of large-scale integrated refinery reaction and fractionation systems from plant data. Part 3: Continuous Catalyst Regeneration (CCR) Reforming Process," Energy & Fuels 2011, 25, 5320-5344 (Year: 2011).

Lloyd's Register, Using technology to trace the carbon intensity of sustainable marine fuels, Feb. 15, 2023.

"Development of Model Equations for Predicting Gasoline Blending Properties", Odula et al., American Journal of Chemical Engineering, vol. 3, No. 2-1, 2015, pp. 9-17.

Bollas et al., "Modeling Small-Diameter FCC Riser Reactors. A Hydrodynamic and Kinetic Approach", Industrial and Engineering Chemistry Research, 41(22), 5410-5419, 2002.

Voutetakis et al., "Computer Application and Software Development for the Automation of a Fluid Catalytic Cracking Pilot Plant—Experimental Results", Computers & Chemical Engineering, vol. 20 Suppl., S1601-S1606, 1996.

Swagelok, Grab Sampling Systems Application Guide, 53 pages.

Frank et al., "Fuel Tank and Charcoal Canister Fire Hazards during EVAP System Leak Testing", SAE International, 2007 World Congress, Detroit, Michigan, Apr. 16-19, 2007, 11 pages.

Doolin et al., "Catalyst Regeneration and Continuous Reforming Issues", Catalytic Naptha Reforming, 2004.

Fraser, Stuart, Distillation in Refining, Distillation Operation and Applications (2014), pp. 155-190 (Year: 2014).

(56) References Cited

OTHER PUBLICATIONS

Yasin et al., Quality and chemistry of crude oils, Journal of Petroleum Technology and Alternative Fuels, vol. 4(3), pp. 53-63, Mar. 2013.
Penn State, Cut Points, https://www.e-education.psu.edu/fsc432/content/cut-points, 2018.
The American Petroleum Institute, Petroleum HPV Testing Group, Heavy Fuel Oils Category Analysis and Hazard Characterization, Dec. 7, 2012.
Increase Gasoline Octane and Light Olefin Yeilds with ZSM-5, vol. 5, Issue 5, http://www.refiningonline.com/engelhardkb/crep/TCR4_35.htm.
Fluid Catalytic Cracking and Light Olefins Production, Hydrocarbon Publishing Company, 2011, http://www.hydrocarbonpublishing.com/store10/product.php?productid+b21104.
Zhang et al., Multifunctional two-stage riser fluid catalytic cracking process, Springer Applied Petrocchemical Research, Sep. 3, 2014.
Reid, William, Recent trends in fluid catalytic cracking patents, part V: reactor section, Dilworth IP, Sep. 3, 2014.
Akah et al., Maximizing propylene production via FCC technology, SpringerLink, Mar. 22, 2015.
Vogt et al., Fluid Catalytic Cracking: Recent Developments on the Grand Old Lady of Zeolite Catalysis, Royal Society of Chemistry, Sep. 18, 2015.
Zhou et al., Study on the Integration of Flue Gas Waste He Desulfuization and Dust Removal in Civilian Coalfired Heating Furnance, 2020 IOP Conf. Ser.: Earth Environ. Sci. 603 012018.
Platvoet et al., Process Burners 101, American Institute of Chemical Engineers, Aug. 2013.
Luyben, W. L., Process Modeling, Simulation, and Control for Chemical Engineers, Feedforward Control, pp. 431-433.
Cooper et al., Calibration transfer of near-IR partial least squares property models of fuels using standards, Wiley Online Library, Jul. 19, 2011.
ABB Measurement & Analytics, Using FT-NIR as a Multi-Stream Method for CDU Optimization, Nov. 8, 2018.
Modcon Systems Ltd., On-Line NIR Analysis of Crude Distillation Unit, Jun. 2008.
ABB Measurement & Analytics, Crude distillation unit (CDU) optimization, 2017.
Guided Wave Inc., The Role of NIR Process Analyzers in Refineries to Process Crude Oil into Useable Petrochemical Products, 2021.
ABB Measurement & Analytics, Optimizing Refinery Catalytic Reforming Units with the use of Simple Robust On-Line Analyzer Technology, Nov. 27, 2017, https://www.azom.com/article.aspx?ArticleID=14840.
Bueno, Alexis et al., Characterization of Catalytic Reforming Streams by NIR Spectroscopy, Energy & Fuels 2009, 23, 3172-3177, Apr. 29, 2009.
Caricato, Enrico et al, Catalytic Naphtha Reforming—a Novel Control System for the Bench-Scale Evaluation of Commerical Continuous Catalytic Regeneration Catalysts, Industrial of Engineering Chemistry Research, ACS Publications, May 18, 2017.
Alves, J. C. L., et al., Diesel Oil Quality Parameter Determinations Using Support Vector Regression and Near Infrared Spectroscopy for Hydrotreationg Feedstock Monitoring, Journal of Near Infrared Spectroscopy, 20, 419-425 (2012), Jul. 23, 2012.
Rodriguez, Elena et al., Coke deposition and product distribution in the co-cracking of waste polyolefin derived streams and vacuum gas oil under FCC unit conditions, Fuel Processing Technology 192 (2019), 130-139.
Passamonti, Francisco J. et al., Recycling of waste plastics into fuels, PDPE conversion in FCC, Applied Catalysis B: Environmental 125 (2012), 499-506.
De Rezende Pinho, Andrea et al., Fast pyrolysis oil from pinewood chips co-processing with vacuum gas oil in an FCC unit for second generation fuel production, Fuel 188 (2017), 462-473.
Niaei et al., Computational Study of Pyrolysis Reactions and Coke Deposition in Industrial Naphtha Cracking, P.M.A. Sloot et al., Eds.: ICCS 2002, LNCS 2329, pp. 723-732, 2002.
Hanson et al., An atmospheric crude tower revamp, Digital Refining, Article, Jul. 2005.
Lopiccolo, Philip, Coke trap reduces FCC slurry exchanger fouling for Texas refiner, Oil & Gas Journal, Sep. 8, 2003.
Martino, Germain, Catalytic Reforming, Petroleum Refining Conversion Processes, vol. 3, Chapter 4, pp. 101-168, 2001.
Baukal et al., Natural-Draft Burners, Industrial Burners Handbook, CRC Press 2003.
Spekuljak et al., Fluid Distributors for Structured Packing Colums, AICHE, Nov. 1998.
Hemler et al., UOP Fluid Catalytic Cracking Process, Handbook of Petroleum Refining Processes, 3rd ed., McGraw Hill, 2004.
United States Department of Agriculture, NIR helps Turn Vegetable Oil into High-Quality Biofuel, Agricultural Research Service, Jun. 15, 1999.
NPRA, 2006 Cat Cracker Seminar Transcript, National Petrochemical & Refiners Association, Aug. 1-2, 2006.
Niccum, Phillip K. et al. KBR, CatCracking.com, More Production—Less Risk!, Twenty Questions: Identify Probably Cuase of High FCC Catalyst Loss, May 3-6, 2011.
NPRA, Cat-10-105 Troubleshooting FCC Catalyst Losses, National Petrochemical & Refiners Association, Aug. 24-25, 2010.
Vivek et al., Assessment of crude oil blends, refiner's assessment of the compatibility of opportunity crudes in blends aims to avoid the processing problems introduced by lower-quality feedstocks, www.digitalrefining.com/article/10000381, 2011.
International Standard, ISO 8217, Petroleum products—Fuels (class F)—Specifications of marine fuels, Sixth Edition, 2017.
International Standard, ISO 10307-1, Petroleum products—Total sediment in residual fuel oils—, Part 1: Determination by hot filtration, Second Edition, 2009.
International Standard, ISO 10307-2, Petroleum products—Total sediment in residual fuel oils—, Part 2: Determination using standard procedures for aging, Second Edition, 2009.
Ebner et al., Deactivatin and durability of the catalyst for Hotspot™ natural gas processing, OSTI, 2000, https://www.osti/gov/etdeweb/servlets/purl/20064378, (Year: 2000).
Morozov et al., Best Practices When Operating a Unit for Removing Hydrogen Sulfide from Residual Fuel Oil, Chemistry and Technology of Fuels and Oils, vol. 57, No. 4, Sep. 2001.
Calbry-Muzyka et al., Deep removal of sulfur and trace organic compounds from biogas to protect a catalytic methananation reactor, Chemical Engineering Joural 360, pp. 577-590, 2019.
Cheah et al., Review of Mid- to High-Tempearture Sulfur Sorbents for Desulfurization of Biomass- and Coal-derived Syngas, Energy Fuels 2009, 23, pp. 5291-5307, Oct. 16, 2019.
Mandal et al., Simultaneous absorption of carbon dioxide of hydrogen sulfide into aqueous blends of 2-amino-2-methyl-1 propanol and diethanolamine, Chemical Engineering Science 60, pp. 6438-6451, 2005.
Meng et al., In bed and downstream hot gas desulphurization during solid fuel gasification: A review, Fuel Processing Technology 91, pp. 964-981, 2010.
Okonkwo et al., Role of Amine Structure on Hydrogen Sulfide Capture from Dilute Gas Streams Using Solid Adsorbents, Energy Fuels, 32, pp. 6926-6933, 2018.
Okonkwo et al., Selective removal of hydrogen sulfide from simulated biogas streams using sterically hindered amine adsorbents, Chemical Engineering Journal 379, pp. 122-349, 2020.

* cited by examiner

| Table 1. Emissions guarantees and predictions for 8H2 Heater. | | Purchase Order: | | Guarantees | | | | Predictions | | |
|---|---|---|---|---|---|---|---|---|---|---|
| | Unit | Buyer's Specification | 8H2 Air Permit | Design w/ 15% Excess Air | Design w/ 25% Excess Air | Normal-SOR | Normal-EOR | EOR-Turndown | Diesel Flush | Hot H2 Stripping |
| Total heat release | MMBtu/hr (LHV) | per Vendor | ≤15 | 76.97 | 76.97 | 29.75 | 34.33 | 18.21 | 21.54 | 15.97 |
| Design burner heat release | MMBtu/hr (LHV) | per Vendor | - | 11.55 | 11.55 | - | - | - | - | - |
| Burner heat release | MMBtu/hr (LHV) | per Vendor | - | 9.62 | 9.62 | 3.72 | 4.29 | 4.55 | 5.39 | 3.99 |
| Bridgewall temperature | °F | per Vendor | - | 1574 | 1561 | 1163 | 1271 | 1070(8) | 1020(8) | 970(5) |
| Draft at the heater floor | in WC | per Vendor | - | 0.52 | 0.52 | 0.48 | 0.49 | 0.47 | 0.46 | 0.45 |
| Specific design features to meet emissions guarantee<br>Air Rings for "LC Risers": Installed or Not Installed | - | per Vendor | - | Installed(4) | Installed(4) | Installed(2) | Installed | Installed | Primary Air Rings Not Installed | Primary Air Rings Not Installed |
| Staged Fuel Risers valves: Open/Closed | - | per Vendor | - | Open | Open | Open | Open | Open/Closed | Open/Closed | Open/Closed |
| NOx emissions | lb/MMBtu(HHV) | 0.025 | 0.04 | 0.025(4) | 0.029(4) | 0.025 | 0.025 | 0.025 | 0.025 / 0.035 | 0.025 / 0.035 |
| CO emissions | lb/MMBtu(HHV) | 0.01 | 0.01 | 0.01 | 0.01 | 0.01(3) | 0.01(3) | 0.02/0.01 | 0.01 | 0.02/0.01 |

FIG. 8

METHODS AND SYSTEMS FOR MINIMIZING $NO_x$ AND CO EMISSIONS IN NATURAL DRAFT HEATERS

CROSS-REFERENCE TO RELATED APPLICATION

This application is a continuation of U.S. Non-Provisional application Ser. No. 15/929,932, filed May 29, 2020, titled "METHODS AND SYSTEMS FOR MINIMIZING NOX AND CO EMISSIONS IN NATURAL DRAFT HEATERS," which claims priority to and the benefit of U.S. Provisional Application No. 62/854,372, filed May 30, 2019, titled "METHOD AND APPARATUS FOR MINIMIZING NOX AND CONTROLLING CO EMISSIONS IN NATURAL DRAFT VERTICAL FURNACES," the disclosures of which are incorporated herein by reference in their entireties.

FIELD OF THE DISCLOSURE

The disclosure herein relates to systems and methods for minimizing $NO_x$ and controlling CO emissions in natural draft heaters.

BACKGROUND

Fired heaters are well-known and extensively used in the oil and gas industry. Generally, fired heaters are direct-fired heat exchangers that use hot combustion gases to raise the temperature of a process fluid flowing through heating coils arranged inside the heater. Fired heaters typically contain one or more burner air registers therein, which control the mixing of fuel and air during the fuel combustion process. The fired heaters may be designed to use refinery fuel gas and/or city natural gas and may operate under a wide range of operating conditions.

Fired heaters are used in several industrial processes and are designed in various configurations to meet unique applications associated with a given industrial process. Irrespective of design, fired heaters commonly contain at least three main components, including a heating coil, an enclosed structure (e.g., including a firebox and a stack), and combustion equipment (e.g., including one or more burners/air registers). The heating coil may include tubes connected together in series that carry the charge (e.g., process fluid) that is being heated, for example, when heat within the firebox is transferred to the charge passing through the tubes. The heating coil absorbs the heat mostly by radiant heat transfer and convective heat transfer from gases (e.g., flue gases), which are vented to the atmosphere through the stack. The firebox is commonly a structure (e.g., constructed of steel) that forms an enclosure lined with a refractory material that holds the heat that is generated by burning a fuel in one or more burners. The one or more burners may be positioned either in the floor of the firebox (e.g., in a vertical draft heater) or on the sidewalls of the firebox (e.g., in a horizontal draft heater). Combustion air is typically drawn through the system from the outside atmosphere and various control instruments and schemes are commonly provided to control the fuel firing rate and air flow through the system to maintain the desired operating conditions.

Burning or combustion of the fuel gas in a fired heater generally results in an exothermic reaction from the rapid combination of oxygen with fuel (oil or gas). Most fuels used in fired heaters contain hydrocarbons and at least some amount of sulfur. Since perfect mixing of stoichiometric quantities of fuel and air is not feasible, excess air is needed to ensure complete fuel combustion in the fired heater. Excess air is commonly expressed as a percentage of theoretical quantity of air required for perfect stoichiometric combustion. It is generally undesirable to operate with less than stoichiometric combustion air, as such operation may lead to a smoking stack and will cause incomplete combustion of the fuel. Incomplete combustion does not provide the maximum amount of energy from the fuel. Further, when fuel is combusted with insufficient air, undesirable components such as carbon monoxide (CO) and hydrogen will appear in the flue gases.

The configuration and/or design of fired heaters may vary and any given fired heater is commonly classified with respect to its draft design. API Standard 560 defines "draft" as the negative pressure or vacuum of the air and/or flue gas at any point in the heater. Generally, hot flue gases within the firebox and stack are lighter than the relatively cold ambient air, thus resulting in a slightly negative pressure inside the heater. Common fired heater draft designs include, but are not limited to, forced draft heaters, induced draft heaters, balanced draft heaters, and natural draft heaters. In a forced draft heater, air is supplied using a centrifugal fan commonly referred to as a forced draft (FD) fan, which forces air through the system. Such heater configurations generally provide for high air velocity, better air/fuel mixing, and small overall burner size. However, the stack is still needed, in addition to the fan, to create a negative draft inside the furnace. In an induced draft heater, an induced draft (ID) fan is typically used to remove flue gas from the heater and to pull air through the burner and into the combustion zone. A negative pressure inside the furnace ensures air supply to the burners from the atmosphere. In a balanced draft heater, both an FD fan and an ID fan are used within the heater to push and pull combustion air through the burner and into the combustion zone. In this way, the amount of air delivered by the FD fan and the ID fan may be controlled and/or balanced. Natural draft heaters are the most common type of fired heaters. In a natural draft heater, air is drawn into the heater by a draft created by the stack. Generally, the stack height controls the draft created within the natural draft heater (e.g., the higher the stack, the higher the draft created therein). The negative pressure differential created by the draft generally allows for combustion air to be drawn into the burners, through the firebox, with the flue gases eventually flowing out of the stack.

It is important to minimize emissions and, in particular, $NO_x$ and CO emissions, from fired heaters, as these emissions limits are heavily regulated by governmental agencies, such as the Environmental Protection Agency (EPA) in the United States. For example, recent environmental regulations have created a requirement for reduction of $NO_x$ and CO emissions for natural draft heaters that has not been previously achievable in industry. Reduction of $NO_x$ and CO emissions presents various process challenges (especially in existing heaters) and may be extremely costly. Those in the industry are continuously looking for cost-efficient ways to reduce these emissions both in existing and new fired heaters to comply with constantly changing regulations.

SUMMARY OF THE DISCLOSURE

The disclosure herein provides one or more embodiments of systems and methods for reducing $NO_x$ and CO emissions in fired heaters through incorporation of various design specific components/equipment and/or operational schemes. In particular, the disclosure provides design modifications for new and/or existing fired heaters to reduce $NO_x$ and CO emissions therefrom, which may be used independently or in various combinations. Such systems and methods, when used in combination, may advantageously provide $NO_x$ emissions from natural draft heaters not exceeding 0.025 lb/MMBtu higher heating value (HHV) and CO emissions from natural draft heaters not exceeding 0.01 lb/MMBtu higher heating value (HHV).

In one or more aspects, the disclosure provides one or more natural draft heater systems. An embodiment of a system, for example, may include a heater shell having a base and designed to circulate a flue gas internally therein via negative pressure. In some embodiments, the flue gas may be generated by combustion of a fuel within the heater shell. Another embodiment of a system, for example, may include one or more heating coils positioned within the heater shell. In some embodiments, the one or more heating coils may contain a process fluid therein and the one or more heating coils may be arranged to transfer heat from the circulated flue gas to heat the process fluid. Some embodiments of systems may include a draft sensor positioned within the heater shell to measure a negative pressure of the flue gas within the heater shell during operation of the natural draft heater.

An embodiment of a system, for example, may include a stack attached to the heater shell for venting of at least a portion of the circulated flue gas to atmosphere. In some embodiments, the stack may include an outer shell and a split-range stack damper positioned within the outer shell to maintain a negative pressure of the flue gas being vented from the natural draft heater. In still other embodiments, the split-range stack damper may have one or more components, for example, a set of inner blades, a set of outer blades, and one or more actuators arranged to actuate the set of inner blades and the set of outer blades to thereby effectuate movement thereof.

Some embodiments of systems as described herein may include, for example, at least one burner assembly connected proximate the base of and within the heater shell to combust the fuel when supplied thereto. In some embodiments, combustion of the fuel in the at least one burner assembly may generate flue gas that transfers heat to the process fluid contained within the one or more heating coils. Generally, the at least one burner assembly in the systems of the disclosure include one or more different components. In some embodiments, for example, the at least one burner assembly may include a burner positioned within the at least one burner assembly to ignite the fuel when being supplied to the burner. In some embodiments, the at least one burner assembly may include a burner air sensor positioned adjacent the burner to measure a level of excess air. In some embodiments, the at least one burner assembly may include an air plenum adjacent to the burner to distribute air into the burner, the air plenum including an air input to receive atmospheric air. In still other embodiments, the at least one burner assembly may include a burner air register in fluid communication with the air input to direct the atmospheric air into the air plenum. In certain embodiments, the burner air register may have a housing and one or more plates attached to the housing and positioned in fluid communication with the air plenum to direct air flow into the plenum. In some embodiments, the burner air register may have a handle attached to the housing thereof to adjust the position of the one or more plates to effectuate a movement thereof. In some embodiments, each of the one or more plates may be configurable between one or more of an open position, a partially open position, and a closed position to selectively supply air to the air plenum.

An embodiment of a system, for example, may also include a fuel supply system in the at least one burner assembly. In some embodiments, for example, the fuel supply system may include at least a fuel input conduit to deliver fuel to the burner. In some embodiments, for example, the fuel supply system may include a primary manifold assembly and optionally a second, staged manifold assembly. In certain embodiments, the fuel input conduit may be positioned in fluid communication with the primary manifold assembly. In some embodiments, the primary manifold assembly may be positioned in fluid communication with one or both of a burner tip of the burner and the second, staged manifold assembly to deliver fuel to one or both of the burner tip of the burner and the second, staged manifold assembly. In some embodiments, the second, staged manifold assembly may be positioned in fluid communication with another burner tip to deliver fuel to the another burner tip. In yet other embodiments, the second, staged manifold assembly may include a staged manifold valve configurable to be in a closed position to shut off fuel flow or in an at least partially open position to direct a preselected amount of fuel to the another burner tip to achieve a desired concentration of air and fuel mixture in the another burner tip.

An embodiment of a system, for example, may include a controller in electrical communication with the various components within the natural draft heater system. For example, in some embodiments, the controller may be in electrical communication with at least the burner air register, the burner air sensor, the draft sensor, and the one or more actuators in the split-range stack damper to control the negative pressure of the flue gas within the heater shell to deliver an amount of excess air to the burner to thereby maintain at least one of $NO_x$ emissions not exceeding 0.025 lb/MMBtu (HHV) and CO emissions not exceeding 0.01 lb/MMBtu (HHV) in the natural draft heater.

Other embodiments of systems, for example, may include a controller capable of performing various functionalities. For example, in some embodiments, the controller may receive an input signal representative of negative pressure of the flue gas from the draft sensor. In some embodiments, the controller may then provide an output signal to the one or more actuators in the split-range stack damper to adjust the positioning of the set of inner blades and the set of outer blades of the split-range stack damper and thereby maintain the negative pressure of the flue gas to within a preselected range. For example, in some embodiments, the preselected range may be maintained in the range of about 0.10-inches water-column to about 0.15-inches water-column. In certain other embodiments, the controller may receive an input signal representative of excess air level from the burner air sensor. In some embodiments, the controller may provide an alert to an operator to adjust configuration of the one or more plates and thereby control the excess air in the burner to a value in the range of between about 15% to about 25% by weight based on the combined weight of air and fuel needed for complete combustion.

Further embodiments of systems, for example, may include a burner fuel tip positioned within the burner and a riser plate positioned adjacent thereto at least partially enclosing the burner fuel tip. In some embodiments, the riser plate may have a burner riser positioned proximate a base thereof and connected thereto by one or more riser welds to allow air to enter the riser plate between riser welds during operation of the natural draft heater. An embodiment of a system as described herein may also include, for example, one or more air rings positioned about the burner riser proximate the one or more riser welds to reduce air entering the riser plate. For example, in some embodiments, the one or more air rings are positioned to reduce air entering the riser plate when the natural draft heater is operating at rates greater than about 40% of design capacity. In certain other embodiments, natural draft heater systems as described herein may include a silicone seal applied at the connection between the burner risers and the riser plates to further prevent air infiltration into the burner thereby reducing $NO_x$ formation in the heater shell.

An embodiment of a system, for example, may include a flame scanner positioned adjacent the air plenum to detect the presence of a flame in the burner. In some embodiments, a purge air injection input may be positioned adjacent the flame scanner to deliver purge air directly to the burner. For example, in such embodiments the purge air being may be used as combustion air by the burner thereby reducing $NO_x$ formation within the heater shell.

Other aspects of the disclosure provide methods of reducing at least one of $NO_x$ and CO emissions in natural draft heaters. An embodiment of a method, for example, includes measuring a selected draft value related to the negative pressure of flue gas within the heater shell when operation of the natural draft heater occurs. Another embodiment of a method may include adjusting a split-range stack damper associated with the natural draft heater to maintain the selected draft value to within a preselected range. For example, in some embodiments, the preselected range of the selected draft value may be maintained in the range of about 0.10-inches water-column to about 0.15-inches water-column to provide the desired negative pressure within the natural draft heater. Still another embodiment of a method may include measuring an excess air level in a burner when operation of the natural draft heater occurs. An embodiment of a method, for example, may include controlling excess air in a burner associated with the natural draft heater to a value in the range of between about 15% to about 25% by weight based on the combined weight of air and fuel needed for complete combustion within the burner. Some embodiments of a method, for example, may include controlling the draft within the heater shell within a preselected range thereby to control the amount of excess air in the burner and maintain at least one of $NO_x$ emissions not exceeding 0.025 lb/MMBtu (HHV) and CO emissions not exceeding 0.01 lb/MMBtu (HHV) in the natural draft heater.

An embodiment of a method, for example, may include detecting the presence of a flame in the burner when operation of the natural draft heater occurs. Another embodiment of a method may include, for example, injecting a purge air directly into the burner, the purge air being used as combustion air by the burner to thereby reduce $NO_x$ formation within the heater shell. Further embodiments of methods, for example, may include sealing one or more connections proximate the burner to prevent air infiltration into the burner to thereby reduce $NO_x$ formation in the heater shell.

These and other features, aspects, and advantages of the disclosure will be apparent from a reading of the following detailed description together with the accompanying drawings, which are briefly described below. The disclosure includes any combination of two, three, four, or more features or elements set forth in this disclosure or recited in any one or more of the claims, regardless of whether such features or elements are expressly combined or otherwise recited in a specific embodiment description or claim herein. This disclosure is intended to be read holistically such that any separable features or elements of the disclosure, in any of its aspects and embodiments, should be viewed as intended to be combinable, unless the context of the disclosure clearly dictates otherwise.

BRIEF DESCRIPTION OF THE DRAWINGS

Figure 1A:
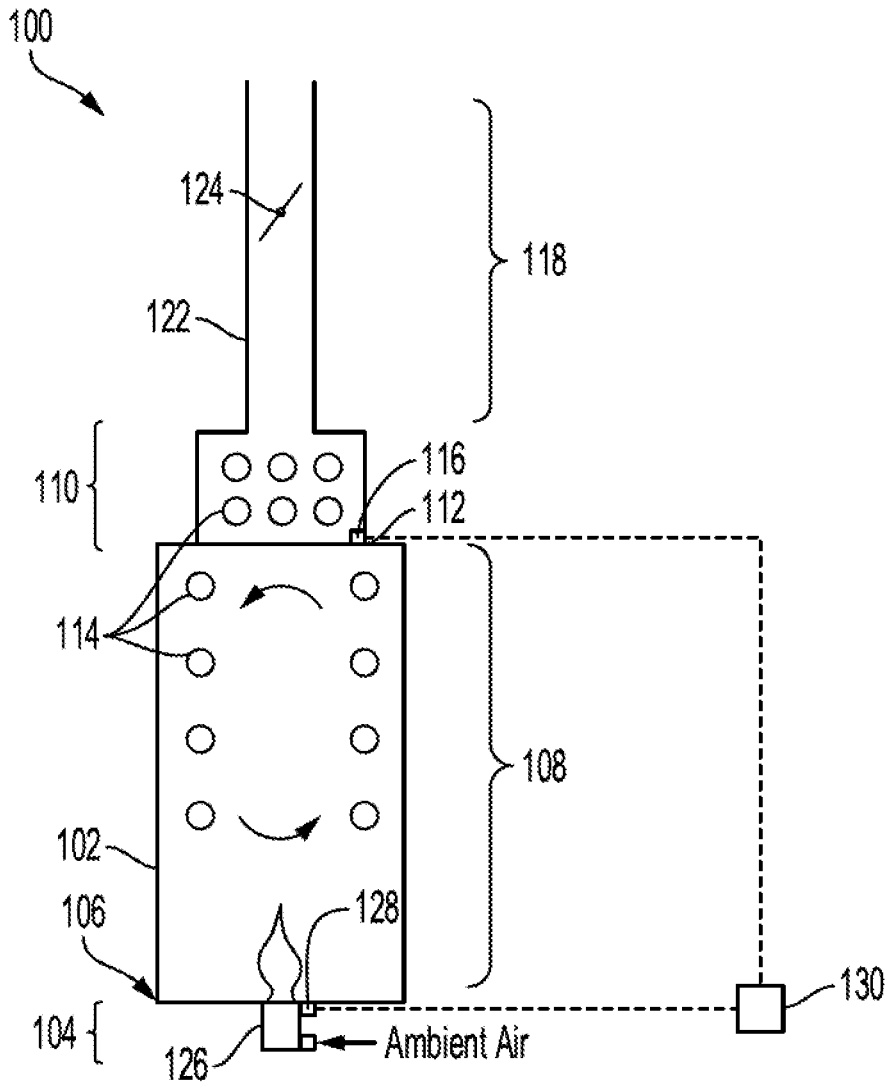
Figure 1B:
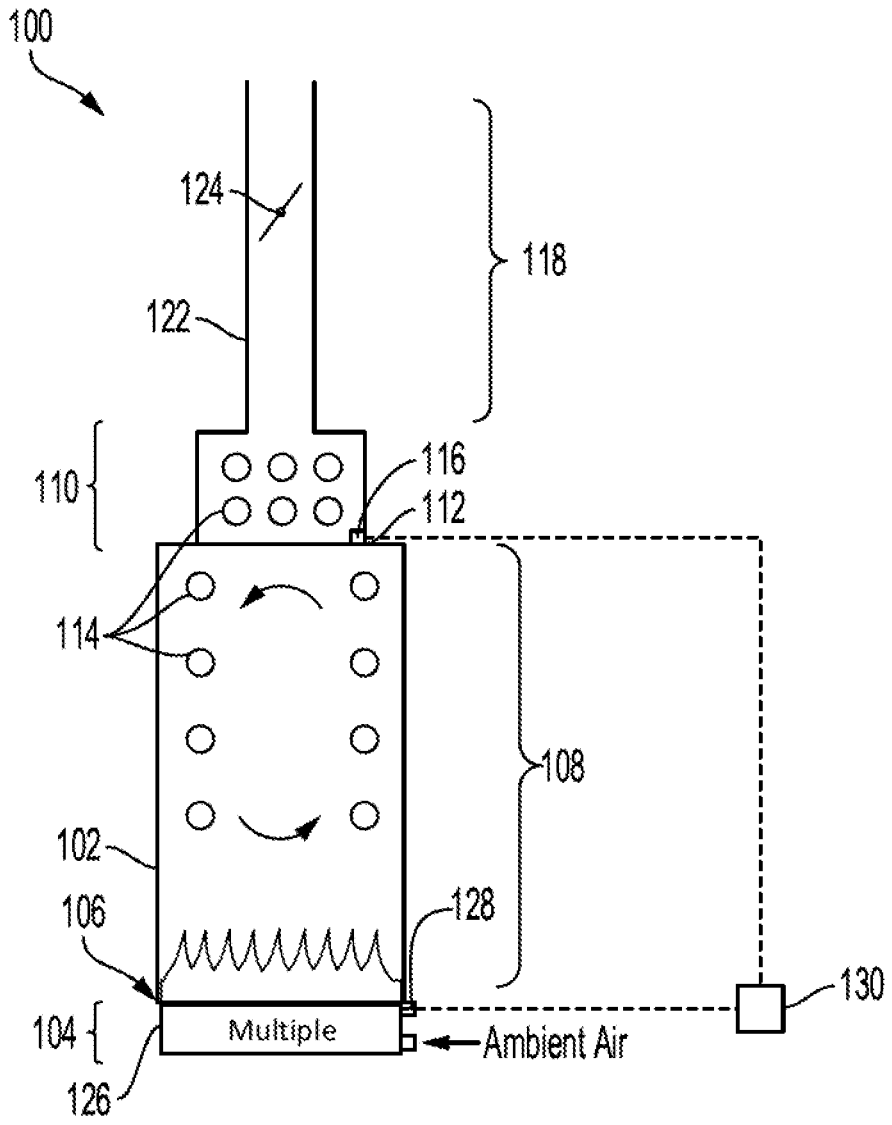
Figure 2:
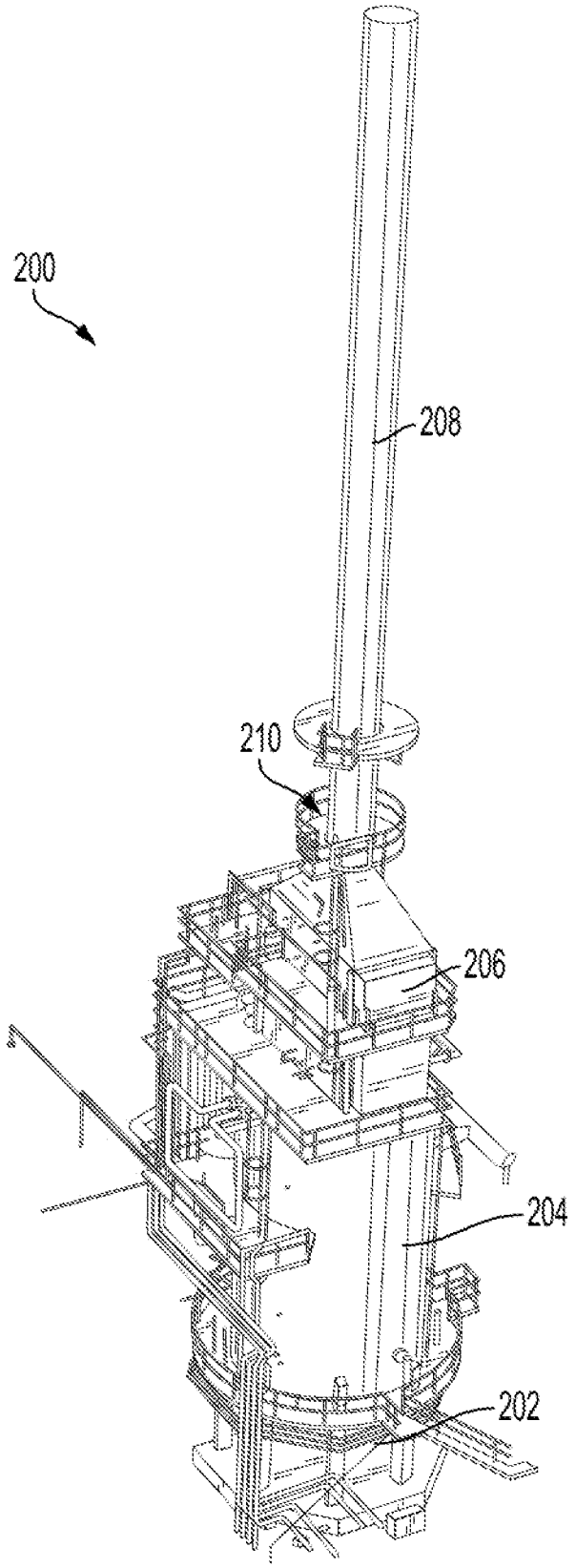
Figure 3B:
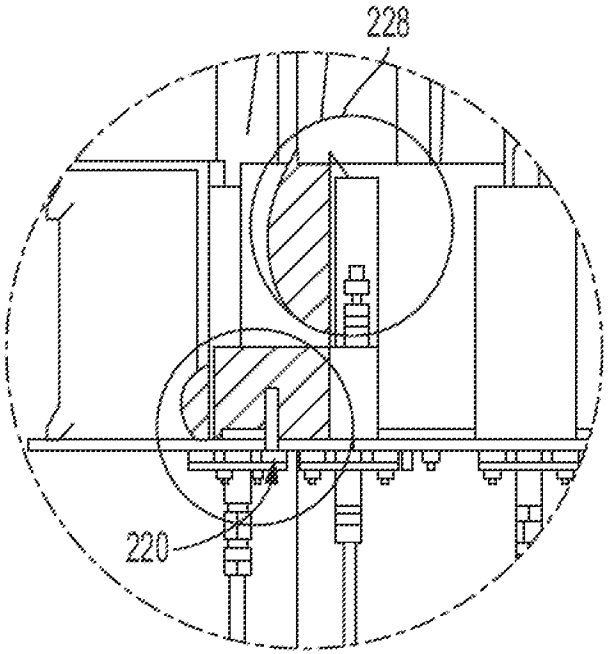
Figure 3A:
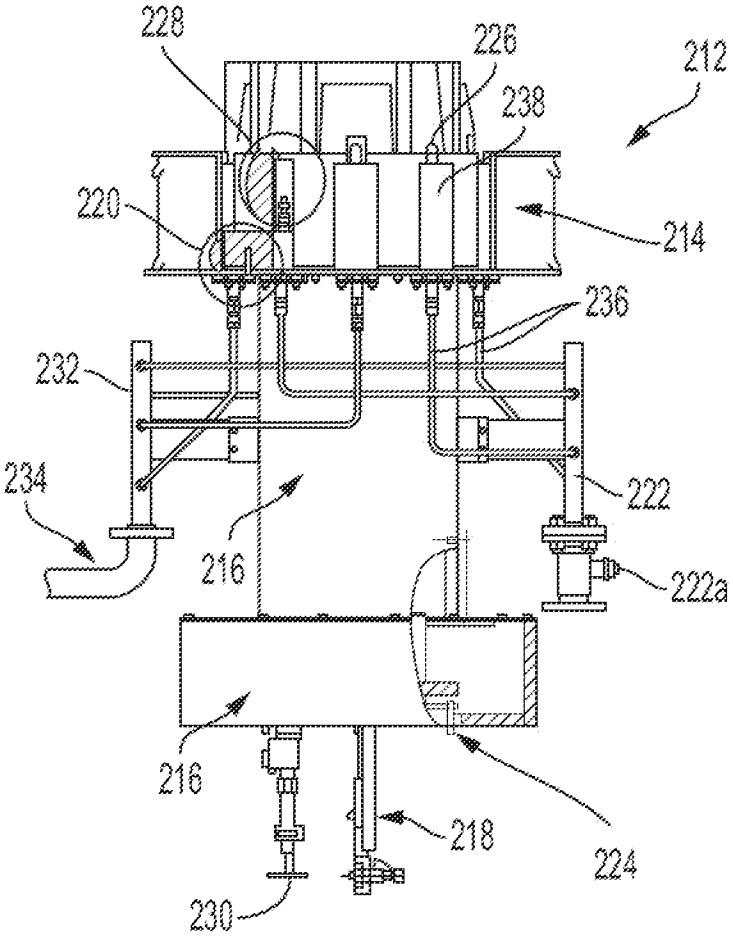
Figure 4B:
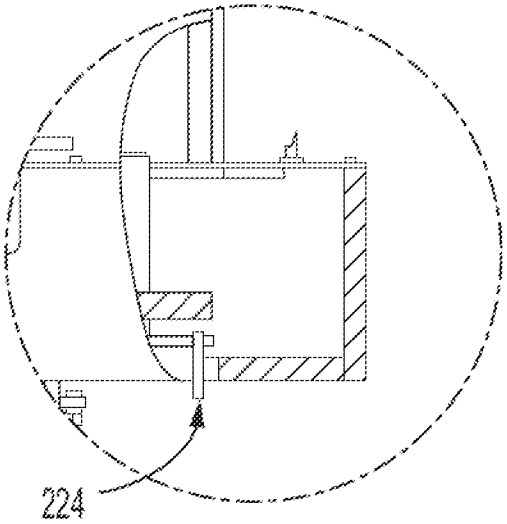
Figure 4A:
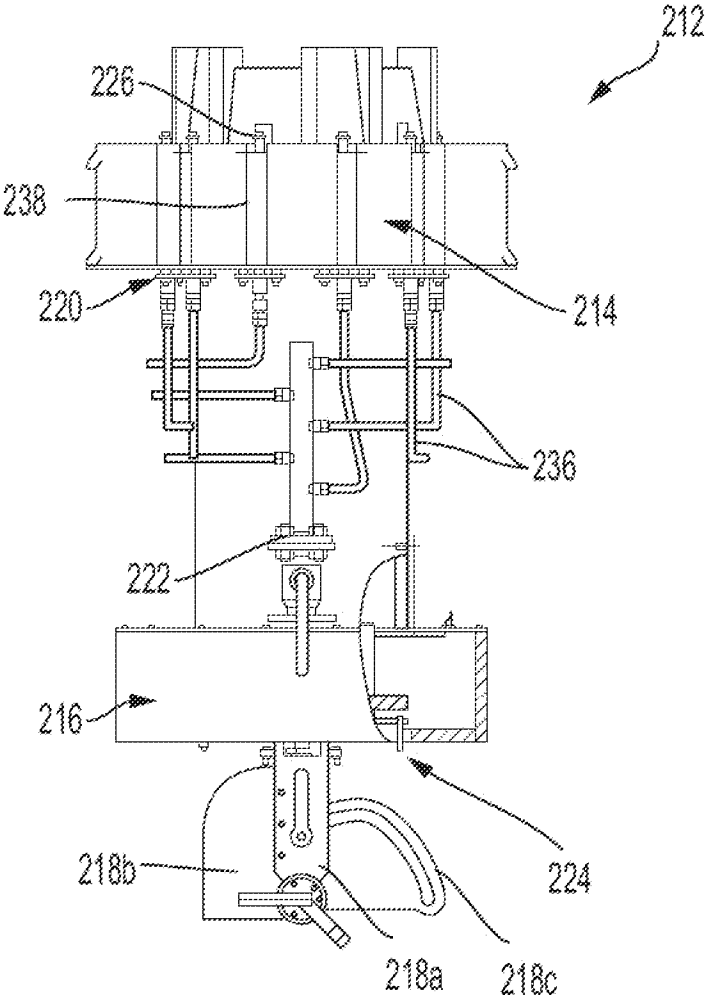
Figure 5B:
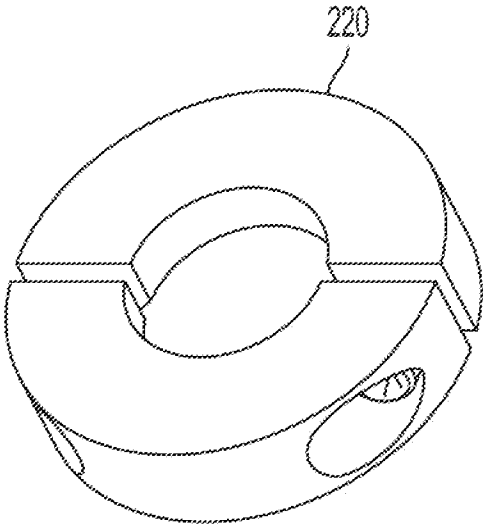
Figure 5A:
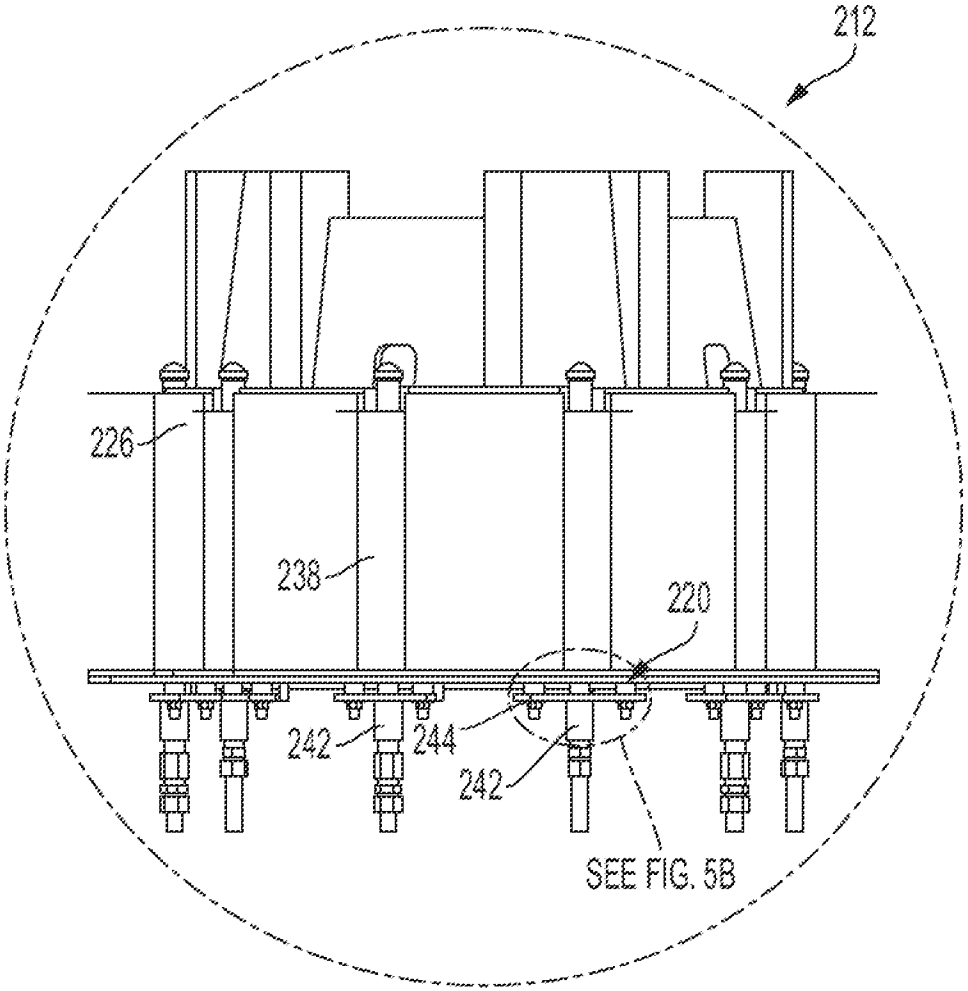
Figure 6:
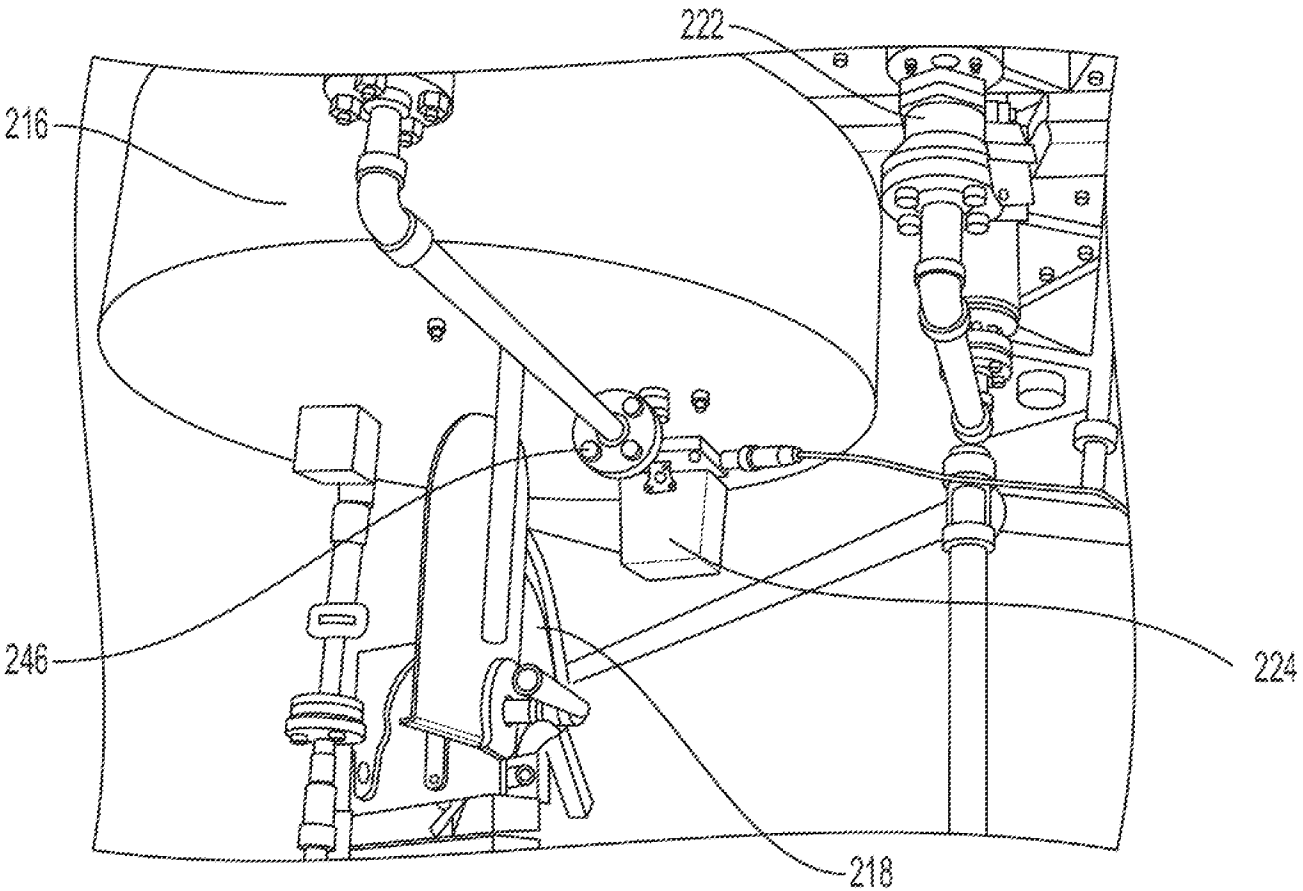
Figure 7:
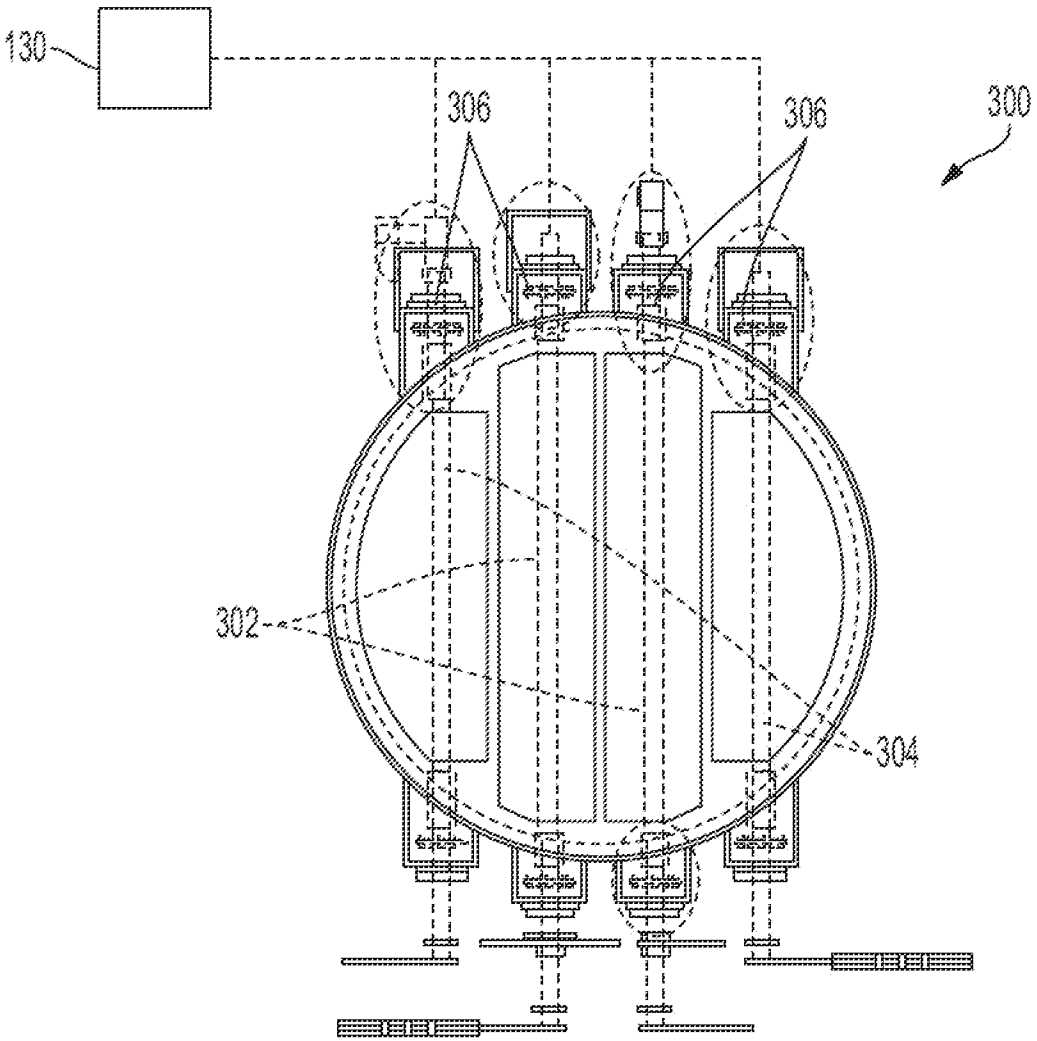
Figure 9:
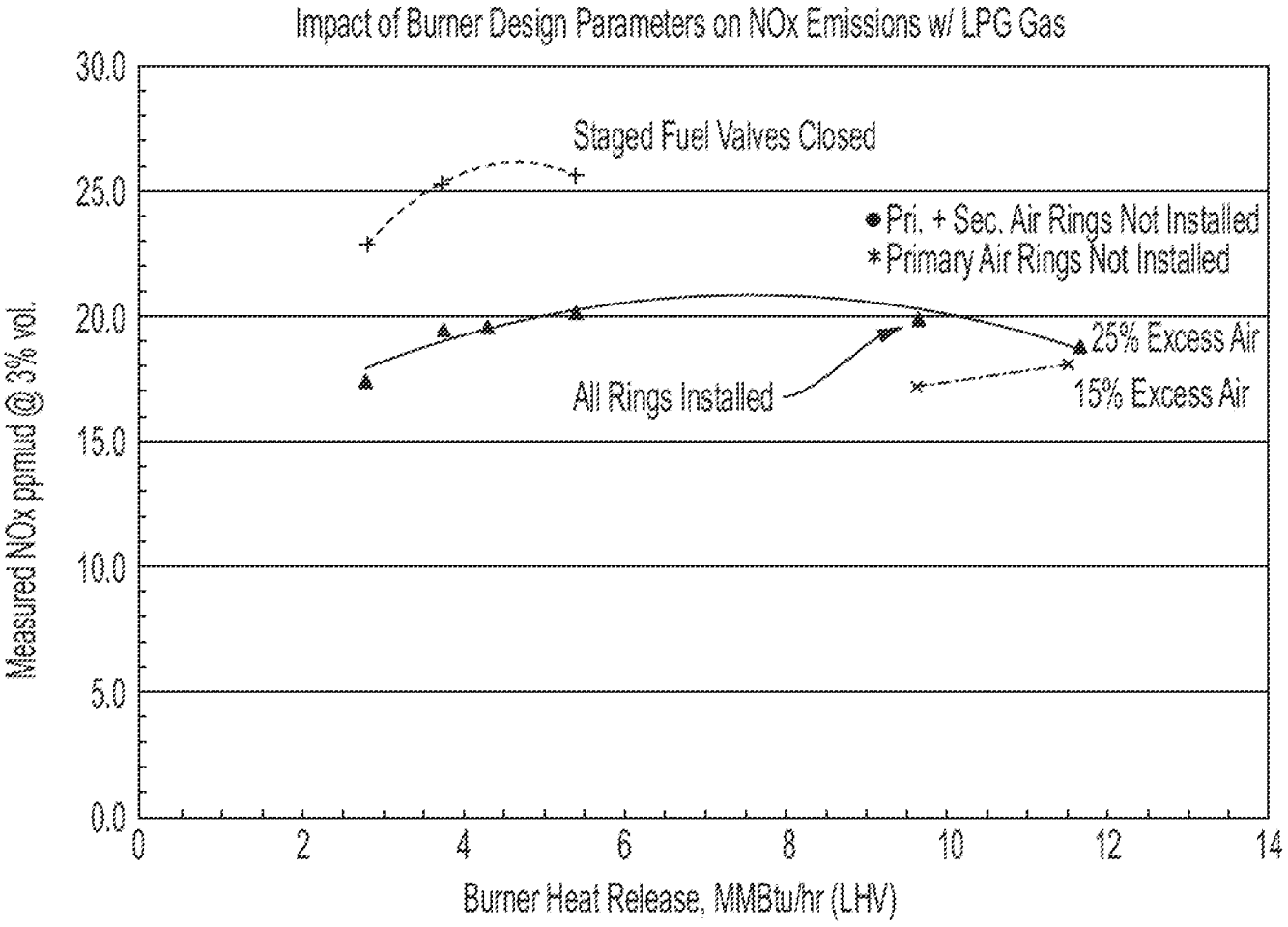
Figure 10:
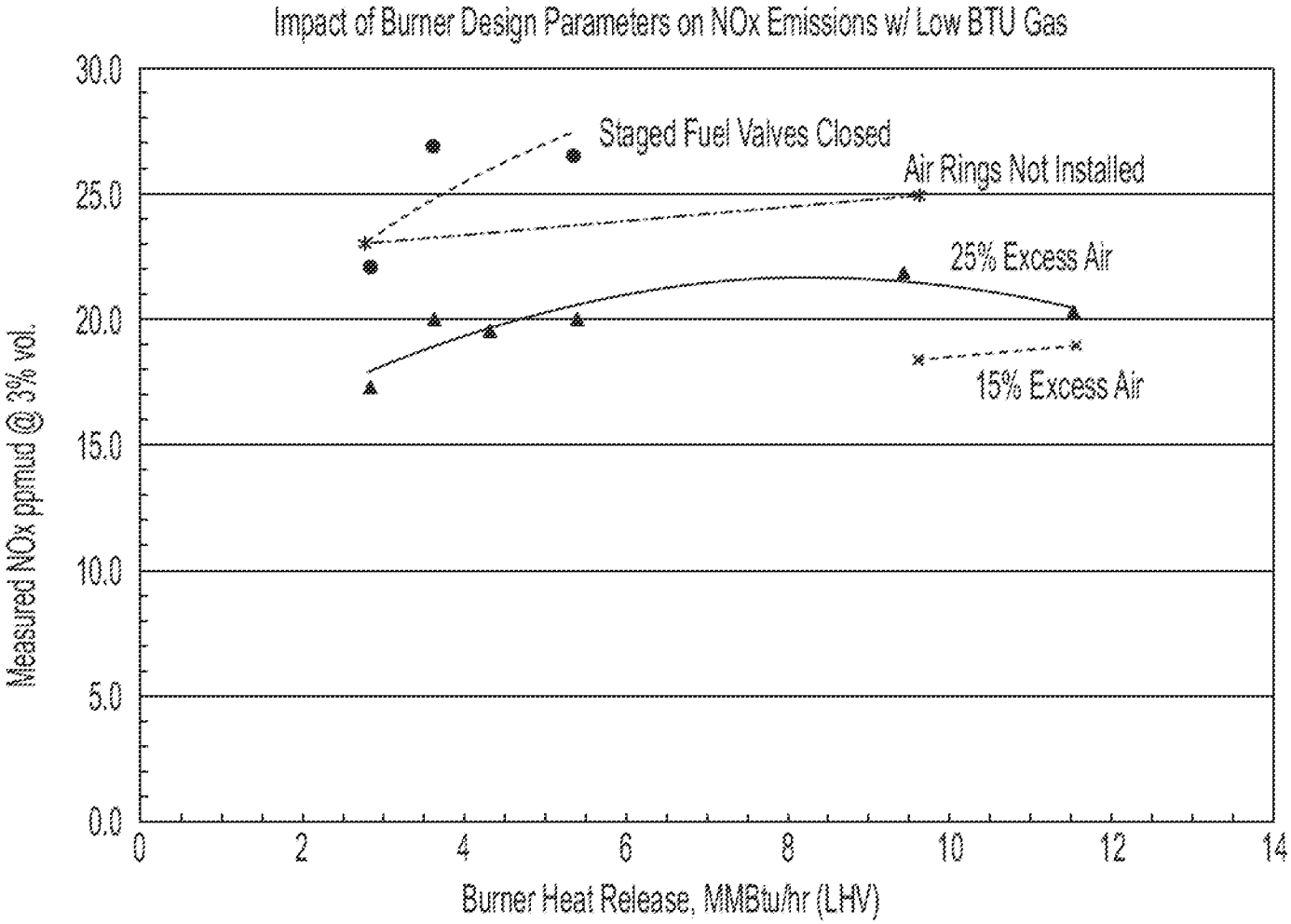

Having thus described the disclosure in general terms, reference will now be made to the accompanying drawings, which are not necessarily drawn to scale, and wherein:

FIG. 1A is a schematic diagram of a natural draft heater according to an embodiment of the disclosure, and FIG. 1B is a schematic diagram of a natural draft heater with multiple burners according to an embodiment of the disclosure;

FIG. 2 is a perspective view of a large scale natural draft heater, including a plurality of burner assemblies positioned proximate a base of the heater shell, according to an embodiment of the disclosure;

FIG. 3A is a side elevation view of a burner assembly for use in a natural draft heater according to an embodiment of the disclosure;

FIG. 3B is an enlarged sectional view of two different components of the burner assembly as shown in FIG. 3A, including a pilot burner configuration and an air ring installed at the base of a burner riser, according to an embodiment of the disclosure;

FIG. 4A is a front elevation view of a burner assembly for use in a natural draft heater according to an embodiment of the disclosure;

FIG. 4B is an enlarged sectional view of a component of the burner assembly as shown in FIG. 4A, including a flame scanner positioned adjacent the air plenum, according to an embodiment of the disclosure;

FIG. 5A is an elevation view of an upper portion of a burner assembly, including a burner riser, a riser plate, a riser weld, and an air ring, according to an example embodiment of the disclosure;

FIG. 5B is an exploded perspective view of an air ring for installation in a burner assembly according to an embodiment of the disclosure;

FIG. 6 is a perspective view of a lower portion of a burner assembly, including an air plenum, a burner air register, a staged manifold assembly, a flame scanner, and a flame scanner, according to an embodiment of the disclosure;

FIG. 7 is a top plan schematic view of a split-range stack damper in electrical communication with a controller, according to an embodiment of the disclosure;

FIG. 8 is a data table that illustrates the calculated $NO_x$ and CO emissions guarantees for a natural draft heater system according to an embodiment of the disclosure;

FIG. 9 is a graph of burner heat release versus measured $NO_x$ showing the impact of various burner design parameters on $NO_x$ emissions in a natural draft heater system according to an embodiment of the disclosure; and FIG. 10 is a graph of burner heat release versus measured $NO_x$ showing the impact of various burner design parameters on $NO_x$ emissions in a natural draft heater system according to an embodiment of the disclosure.

DETAILED DESCRIPTION OF THE DISCLOSURE

The disclosure now will be described more fully hereinafter with reference to specific embodiments and particularly to the various drawings provided herewith. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a," "an," "the," include plural referents unless the context clearly dictates otherwise.

The disclosure provides embodiments of methods and systems for reducing $NO_x$ and CO emissions in a fired heater (e.g., a natural draft heater). In particular, as will be provided in further detail below, the methods and systems relate to a combination of design enhancements and operational schemes that may, in some embodiments, be used in unison to lower $NO_x$ and CO emissions in natural draft furnaces. This combination of design enhancements and operational schemes is potentially available for use in all new and/or existing fired heaters and, in particular, for use in all new and/or existing natural draft heaters to provide reductions in $NO_x$ and/or CO emissions. The noted design enhancements and/or operational schemes may provide for substantial reductions in both $NO_x$ and CO emissions in both existing and newly fabricated heaters, in some embodiments, to levels not previously achievable. In particular, certain combinations of operation and design attributes may result in a fired heater that operates with $NO_x$ emissions not exceeding 0.025 lb/MMBTU (HHV) and/or CO emissions not exceeding 0.01 lb/MMBTU (HHV). The noted design enhancements and/or operational schemes may also be effective to reduce at least one of $NO_x$ and CO emissions in natural draft heater systems having a wide variety of operating conditions. In some embodiments, for example, such operation may range from heat absorption duty (100%) to turn down duty (20% of design duty). In some embodiments, the excess air level (the amount of air exceeding that required for complete combustion of the fuel) may be advantageously maintained between 15-25% for the entire operating range to maintain at least one of $NO_x$ emissions not exceeding 0.025 lb/MMBTU (HHV) and/or CO emissions not exceeding 0.01 lb/MMBTU (HHV).

Generally, the methods and systems provided herein for reducing $NO_x$ and CO emissions in heaters may be suitable for use on any type of natural draft heater commonly used in the industry. "Natural draft heater" as used herein, generally refers to any fired heater that uses flue gas buoyancy (e.g., a slightly negative pressure generated inside the heater which pulls atmospheric air therethrough) to support combustion of a fuel source therein. Natural draft heaters may be cylindrical or box type, vertically or horizontally configured, having a variety of different burner configurations and assemblies (e.g., with burners positioned on the sidewall or the floor of the heater), and may vary in height, dimensions, and/or material construction. In some embodiments, natural draft heaters may be designed to use refinery fuel gas and/or city natural gas as the combustible fuel source and may operate under a wide range of operating conditions. Typically, natural draft heaters include four sections: a burner/combustion section, a radiant section, a convective section, and a stack section.

FIG. 1A depicts a process diagram of a non-limiting, natural draft heater system 100 according to one or more embodiments of the disclosure. As shown in FIG. 1A, the natural draft heater system 100 includes a heater shell 102 designed to circulate flue gas internally therein via negative pressure. In some embodiments, the flue gas being generated in the heater shell 102 is generated by combustion of a fuel, e.g., refinery oil/gas and/or natural gas. In one or more embodiments, such as the embodiment depicted in FIG. 1A, the heater shell may include a base 106, a burner section 104, a radiant section 108, and a convective section 110. In some embodiments, the base 106 of the heater shell may sometimes be referred to as the floor of the heater shell, for example, when the heater shell in a vertical configuration such that the base of the heater shell is positioned at the bottom thereof. Generally, the terms "base" and/or "floor" and/or "bottom" are meant to be interchangeable as used herein in reference to a point in the heater shell. In some embodiments, the burner section 104 may be positioned proximate the base 106 of the heater shell 102 where combustion of the fuel occurs, for example. In some embodiments, the radiant section 108 may be positioned proximate the burner section 104, for example, to receive heat energy from the burner section and the radiate heat energy therefrom. In some embodiments, the convective section 110 may be positioned proximate the radiant section 108, for example, to provide convection from the radiant section.

In one or more embodiments, natural draft heater systems as described herein may include one or more heating coils 114 positioned within the heater shell. In some embodiments, the one or more heating coils 114 may be positioned within one or both of the radiant section 108 of the heater shell and the convective section 110 of the heater shell. For example, as depicted in FIG. 1A, the one or more heating coils may be positioned in both the radiant section and the convective section. In some embodiments, one or more heating coils may be separately positioned in both of the radiant section and the convective section of the heater shell, or in other embodiments, a singular heating coil may extend into both the radiant section and the convective section. The configuration and/or arrangement of heating coils within the heater shell is not meant to be limiting and various heating coil configurations and/or arrangements are suitable for use in the heater shell as would be understood by those skilled in the art. In some embodiments, the one or more heating coils may contain a liquid process fluid therein (e.g., typically a fluid having a high heat transfer coefficient) that is capable of flow through the heating coils within the heater shell. Relevant process fluids are known in the industry and any such fluid may be employed in the systems and methods provided herein as will be understood by a skilled person in the art. Generally, when the heater is in operation, heated flue gases generated from combustion of the fuel in the burner travels upward through the radiant and convective sections of the heater, transferring heat to the liquid process fluid (e.g., via radiation and/or convection) in the heating coils, thereby retaining the transferred thermal energy from the flue gas in the process fluid such that it may be used elsewhere in the plant.

In one or more embodiments, natural draft heater systems as described herein may include a bridge wall 112 connected and/or attached to the heater shell 102 at one or more locations within the heater shell. In the embodiment depicted in FIG. 1A, for example, the bridge wall 112 may be connected to the beater shell and positioned between the radiant section 108 and the convective section 110 thereof. Various monitoring equipment may be positioned proximate to the bridge wall in order to provide various measurements and/or emissions reporting functions. For example, an amount of excess oxygen (02) in the system, a concentration of combustible gas, flue gas temperature, and/or draft pressure within the system may be measured from the bridge wall 112. In some embodiments, natural draft heaters may be equipped with continuous emissions monitoring systems (CEMS) near the bridge wall which may measure, e.g. excess $O_2$, $No_x$, and CO emissions (e.g., for regulatory purposes). As noted above, natural draft heaters generally operate under negative pressure to pull ambient air through the heater shell during operation. In some embodiments, a draft sensor 116 may be positioned within the heater shell 102 to measure a negative pressure of the flue gas within the heater shell during operation of the natural draft heater. Typically, the draft sensor may be in the form of a pressure sensor positioned within the heater shell. In some embodiments, the draft sensor 116 may be positioned proximate the bridge wall 112, in particular, to measure a negative pressure at the bridge wall during operation of the natural draft heater, referred to herein as the "bridge wall draft" and/or a "bridge wall draft value," for example. Generally, the location of highest draft pressure in a natural draft heater is typically at the top of the radiant section just below the first shield in the convection section, e.g., proximate to the bridge wall 112. Thus, if the pressure at the bridge wall (i.e., referred to herein as the "bridge wall draft value") is slightly negative, the entire heater will be operating with the negative pressure. In some embodiments, the draft sensor may be in electrical communication with at least a control component 130 and one or more other components within the at least one burner assembly (e.g., a split-range stack damper 124) as will be discussed further herein.

In some embodiments, natural draft heater systems as described herein may include a stack 118 positioned proximate the convective section 110 of the heater shell 102 for venting of at least a portion of the circulated flue gas to the atmosphere. In some embodiments, the height and/or diameter of the stack may vary based on the desired draft in the heater shell and based on one or more operating conditions of the natural draft heater. Generally, the dimensions of the stack may vary as will be understood by a person of skill in the art Referring back to FIG. 1A, in one or more embodiments, the stack 118 may include an outer shell 122 and a split-range stack damper 124 positioned within the outer shell to maintain the bridge wall draft of the flue gas being vented from the natural draft heater. In some embodiments, the split-range damper may have a set of inner blades, a set of outer blades, and one or more actuators arranged to actuate the set of inner blades and the set of outer blades to thereby effectuate movement thereof, as will be discussed further herein with reference to FIG. 7. Advantageously, use of a split-range stack damper may provide for draft control within the natural draft heater across a wide range of operating conditions, as will be discussed further herein.

Common stack dampers have multiple blades that are connected through linkages and thus all blades move when a connected shaft is moved within the stack damper. This common type of stack damper configuration has a limited control range, that may not be as effective in fired heaters that require damper control across a wide range of conditions. However, the split-range damper used according to the systems and methods provided herein advantageously provides for a much higher level of draft control across a wider range of conditions than would be associated with common stack dampers, such as would be understood by a person of skill in this industry. FIG. 7 illustrates a detailed schematic, top-facing view of a split-range stack damper 300 as described herein. As depicted in FIG. 7, for example, the split-range damper 300 has four blades, a set of inner blades 302 operating at low firing rates, and a set of outer blades 304. In some embodiments, the set of inner blades 302 may be configured to operate at low firing rates (e.g., heat absorption duty less than about 50%, less than about 40%, less than about 30%, less than about 20%, or less) and the set of outer blades 304 typically remain closed during operation at low firing rates. However, when higher firing rates are utilized within the heater (e.g., heat absorption duty greater than about 40%, greater than about 50%, greater than about 60%, or more), the two outer blades 304 may also open to allow for more air flow within the system. In some embodiments, the set of inner blades and the set of outer blades may independently be configured to be closed and/or open and/or partially open (e.g., at varying degrees, such as from about 1% to about 99% open) to provide the desired draft conditions within the natural draft heater. For example, when the heater is started up (e.g., combustion occurs in one or more of the burner assemblies), the split-range damper is placed in full, open position (e.g., both the set of inner blades and the set of outer blades are completely open) providing for maximum draft and excess air to the burner. After start-up and as the firing range increases, the draft level within the heater may be tuned and controlled by adjusting the positioning of one or two sets of blades in the split-range damper.

In some embodiments, the split-range damper may also include a damper actuator 306 (or multiple actuators coupled to the individual blades) which are configured to adjust the positioning of the blades in response to control input from the controller 130. For example, the damper actuator 306 may be configured to output a current to the damper blades, based on control input from an operator, wherein each damper blade receives that current output and is configured to open and/or close to a certain degree based on the current output received. In some embodiments, for example, the outer blades 304 are designed to be fully open at a current of about 4 mA (milliamps) and fully closed at about 12 mA and the inner blades 302 are designed to be fully opened at a current of about 12 mA and fully closed at a current of about 20 mA. In such a configuration, as the pressure in the radiant section decreases during turn down, the outer blades start to close at a current of 4 mA while the inner blades remain fully open at a current of 4 mA. As the pressure further decreases within the radiant section, the inner blades will start to close when the current reaches 12 mA with the outer blades already being fully closed at a current of 12 mA. At start up, as the pressure increases within the radiant section, the inner blades will start to open at a current of 20 mA with the outer blades remaining fully closed at a current of 20 mA. At full operation, when the pressure within the radiant section is the highest, the outer blades will start to open at a current of 12 mA with the inner blades already being fully open at a current of 12 mA. Various other control designs and/or schemes may also be suitable for use in the split-range damper and generally, it should be noted, that the particular control configurations discussed herein are provided merely by way of example.

In some embodiments, the burner section 104 may include at least one burner assembly 126, which may have one or more individual components therein (e.g., a burner, an air plenum, air registers, valves, conduits, manifolds, and other components as will be understood by those skilled in the art). In some embodiments, the at least one burner assembly 126 may be connected proximate the base 106 and within the heater shell 102 to combust the fuel when supplied thereto, thereby generating the flue gas that transfers heat to the process fluid contained within the one or more heating coils 114. While the embodiment depicted in FIG. 1A only includes a single burner assembly 126 for the burner section 104, it should be noted that multiple burner assemblies, FIG. 1B, may be included in the burner section 104 of various embodiments of the disclosure. For example, in certain embodiments, the natural draft heater may comprise a plurality of burner assemblies having various configurations and/or arrangements within the burner section of the heater shell. In some embodiments, the natural draft beater may comprise at least one burner assembly, at least 2 burner assemblies, at least 3 burner assemblies, at least 4 burner assemblies, at least 5 burner assemblies, at least 6 burner assemblies, at least 7 burner assemblies, at least 8 burner assemblies, or more burner assemblies in the burner section 104 as will be understood for specific applications pursuant to the disclosure.

FIG. 2, for example, depicts a perspective view of a natural draft heater 200 that is configured to have eight separate burner assemblies installed in the burner section 202. Various configurations and arrangements of natural draft heaters, including the positioning of various sections and/or components therein, may vary as will be understood by a person skilled in the art. FIG. 2 illustrates a three-dimensional view of a large scale natural draft heater system according to one or more embodiments of the disclosure. For example, the natural draft heater depicted in FIG. 2 includes a burner section 202, a radiant section 204, a convective section 206, and a stack section 208, which may optionally include a stack damper 210.

In some embodiments, one or more embodiments of natural draft heater systems according to the disclosure (e.g., as depicted in FIGS. 1A, 1B and 2) may include at least one burner assembly 212, which may include one or more individual components forming the overall burner assembly (e.g., as depicted in FIGS. 3A, 3B, 4A, 4B, 5A, and 5B) For example, FIG. 3A and FIG. 4A illustrate a side view and a front view, respectively, of a burner assembly for use in a natural draft heater according to the present disclosure. Referring now to FIGS. 3A and 4A, in one or more embodiments of the disclosure, the at least one burner 212 assembly may include a burner 214 positioned within the at least one burner assembly to ignite the fuel when being supplied to the burner. In some embodiments, the at least one burner assembly may include a burner air sensor 128 positioned adjacent the burner to measure a level of excess air, for example, referring back to FIG. 1A. In some embodiments, the burner air sensor 128 may be in electrical communication with at least a control component 130 and one or more other components (e.g., a burner air register 218 as shown in FIGS. 3A and 4A) within the at least one burner assembly as will be discussed further herein.

Referring back to FIGS. 3A and 4A, the at least one burner assembly may include an air plenum 216 positioned adjacent the burner to distribute air into the burner. In some embodiments that air plenum may include an air input, i.e., an opening in the air plenum (not pictured), to receive atmospheric air. Generally, the air plenum may work in connection with one or more other components within the at least one burner assembly to deliver air flow directly to the burner. For example, in one or more embodiments, the at least one burner assembly may include a burner air register 218 in fluid communication with the air input to direct the atmospheric air into the air plenum 216. Air registers may be used in burner assemblies for industrial fired heaters, for example, to control the amount of air flow into the system. The methods described herein advantageously include incorporating burner air registers 218 with linear percentage openings to control excess air level in the burner 214 between about 15% to about 25% by weight (based on the combined weight of air and fuel needed for complete combustion) from full design capacity (e.g., heat absorption duty of about 100%) to turn down operating condition range (e.g., heat absorption duty of about 20%). Using a burner air register with linear percentage openings may also provide more accurate control of the excess air level in the burner and/or ease of operation by an operator of natural draft heater.

In some embodiments, for example, the at least one burner assembly may include a burner air register 218 having a housing 218*a*, one or more plates 218*b* movably attached to the housing and positioned in fluid communication with the air plenum 216 to direct air flow through the air plenum, and a handle 218*c* attached to the housing 218*a* to adjust the position of the one or more plates 218*b* to effectuate a movement thereof. In some embodiments, each of the one or more plates may be configurable between one or more of an open position, a partially open position, and a closed position to selectively supply air to the plenum. In some embodiments, for example, the burner air register may include a plate, or more than one plate, positioned at least partially inside the air plenum and connected to the housing of the burner air register. In such embodiments, air enters the air plenum and flows under or around the one or more plates. Generally, the position of the handle, which may be controlled manually by an operator, may control the level of the plates inside the air plenum. Controlling the position of the one or more plates inside or adjacent the air plenum controls the percentage opening (e.g., on a linear scale) available for air to pass through the air plenum and to the burner. Using this linear scale provides the operator with a visual scale so that the operator may see the percentage opening and adjust this percentage opening based one or more readings from a controller to achieve the desired amount of air flow into the air plenum.

A burner air register as described herein may be referred to in some embodiments as a burner air register with linear percentage opening, for example. Advantageously, use of a burner air register with linear percentage openings may provide more efficient control of the excess air in the burner. Generally, the percentage of opening (which may range from 0%/closed to 100%/completely open) may be increased to allow more ambient or atmospheric air to be introduced into the air plenum and/or the burner; the percentage of opening may be decreased to reduce the amount of ambient air introduced into the air plenum and/or the burner. For example, the one or more plates may be configurable to be about 0% open (e.g., in a closed positioned), at least about 10% open, at least about 20% open, at least about 30% open, at least about 40% open, at least about 50% open, at least about 60% open, at least about 70% open, at least about 80% open, at least about 90% open, or about 100% open (e.g., an open position). In some embodiments, proper use of the burner air register may prevent excess air from being delivered directly into the burner in an uncontrolled manner.

In some embodiments, the at least one burner assembly may include a fuel supply system for delivering the fuel to the burner 214, i.e., the individual burner tips of the burner assembly. For example, the fuel supply system may include a fuel input conduit 234, a primary manifold assembly 232, and a second, staged manifold assembly 222. In some embodiments, the fuel input conduit 234 is positioned in fluid communication with the primary manifold assembly 232 to deliver fuel to the primary manifold in a central location in primary manifold. In some embodiments, the primary manifold 232 is in fluid communication with one or both of a burner tip of a burner 214 and the second, staged manifold assembly 222 to deliver fuel to one or both of the burner tip of the burner 214 and the second, staged manifold assembly 222. In some embodiments, the second, staged manifold assembly 222 may be in fluid communication with another burner tip, i.e., one of the burner tips not connected to the primary manifold, to deliver fuel to the another burner tip. In some embodiments, the second, staged manifold assembly may include a staged manifold valve 222*a* configurable to be in a closed position to shut off fuel flow or in an at least partially open position (e.g., between about 1% to about 100% open) to direct a preselected amount of fuel to the another burner tip, i.e., one of the burner tips not connected to the primary manifold, to achieve a desired concentration of air and fuel in the another burner tip. In some embodiments, the fuel supply system may include one or more conduits 236 (e.g., in the form of a conduit, tube, pipe, etc.) in fluid communication with one or more of the primary manifold assembly 232, the second, staged manifold assembly 222, and each of the burner tips of the burner 214 to deliver fuel to one or more of those particular components within the at least one burner assembly.

In some embodiments, the at least one burner assembly includes at least one burner fuel tip 226 positioned within each burner 214 and a riser plate 238 positioned adjacent thereto at least partially enclosing the burner fuel tip. In some embodiments, the riser plate 238 may have a burner riser 242 positioned proximate a base thereof and connected thereto by one or more riser welds 244 to allow air to enter the riser plate 238 between riser welds during operation of the natural draft heater. In some embodiments, the at least one burner assembly may include a plurality of burner fuel tips positioned within the burner assembly 212, for example, as depicted in FIGS. 4A and 5A. In such embodiments, each of the plurality of burner fuel tips may be at least partially enclosed by a separate riser plate and have a separate burner riser positioned proximate the base thereof and connected thereto by one or more riser welds. Generally, the number of burner fuel tips in the burner assembly may vary. For example, the burner assembly may include at least 1 burner fuel tips, at least 2 burner fuel tips, at least 3 burner fuel tips, at least 4 burner fuel tips, or more as would be understood by a skilled person in the art.

Referring now to FIGS. 5A and 5B (e.g., showing an exploded view of an air ring according to the disclosure), in one or more embodiments, the at least one burner assembly may include one or more air rings 220 positioned about the burner riser 242 proximate the one or more riser welds 244 to reduce air entering the riser plate. Typically, air flow into the burner (e.g., via gaps between riser welds 244 on the riser plate 238) may affect the stoichiometry of the air and fuel locally at the burner. Generally, the air rings 220 are designed to reduce the size of the gap that lets air flow up to burner tip 226 located at burner 214. In some embodiments, the air rings are constructed of metal (e.g., such as stainless steel) and are designed to withstand high heat exposure during use. Advantageously, the air rings (when installed at the upper operating rates (e.g., heat absorption duty greater than about 40%) versus not installed at the lower turn down rates (e.g. heat absorption duty less than about 40%) may beneficially contribute to the ability to control $NO_x$ as offset with CO formation. However, the number of air rings and the positioning thereof may generally vary based on the configuration of the natural draft heater.

In some embodiments, installation of the air rings may provide a further range of adjustment of the air flow to the individual burner tips, beyond that which the air register inflow provides. Upon installation of the air rings, the small opening between riser welds, typically allowing ambient air to enter the burner tip, is substantially blocked by the air ring, thereby reducing the amount of oxygen available for combustion at each individual burner tip within the burner. In some embodiments, the air rings may be designed to be removed, for example, removal of the air rings may be necessary under planned start up and/or shut down of one or more burner tips and/or the entire burner assembly. For example, in some embodiments, the one or more air rings may be selectively installed in one of the at least one burner assemblies when that one burner assembly is taken out of service during operation of the natural draft heater so as to prevent air leakage into the burner and/or the heater shell and thereby reduce $NO_x$ formation. In such embodiments, the air rings may be configured to be separately removed from individual burner assemblies. In some embodiments, the air rings may be installed and uninstalled during operation of the natural draft heater, which may provide for some degree of emissions control during use of the heater. For example, uninstalling the air rings during operation may provide a reduction in CO production locally at the burner; however, this reduction comes at the cost of $NO_x$ emissions at the main heater stack outlet.

In some embodiments, a silicone seal (not pictured) may be applied to at one or more connections between the burner risers 242, the riser plates 238, and the riser welds 244 (e.g., as depicted by the circled portion in FIG. 5A). Generally, as noted above, the connections between the burner risers, the riser plates, and the riser are not air tight and may have gaps therein. For example, these connection points in common burner assemblies may undesirably allow air penetration into the burner and/or the heater shell which has an undesirable effect on $NO_x$ and CO emissions therefrom. However, application of high temperature silicone seals to one or more of these connection points within the at least one burner assembly may advantageously prevent unwanted air infiltration into the heater thereby reducing $NO_x$ formation in the heater shell. Application of the high temperature silicone seals may vary in application methods and/or configuration, for example, the high temperature silicone seal may be in the form of a silicone gasket and/or a silicone sleeve and/or a silicone seal and may be applied via any method commonly used in the art as would be known by a person skilled in the art.

In some embodiments, the at least one burner assembly 212 may include a flame scanner 224 positioned adjacent the air plenum 216 to detect the presence of a flame in the burner 214, for example, as depicted in FIGS. 3A, 4A, and 4B (e.g., showing a cut away view of the flame scanner 224 attached to the air plenum 216). Generally, a flame scanner operates as an electric eye looking at the flame to ensure the burner is producing a flame therefrom. For example, the air plenum 216 has a generally hollow interior allowing the flame scanner 224 to observe a flame in the burner from a distance below the actual burner. Any type of flame scanner typically used in natural draft heaters as would be understood by a person of skill in the art may be suitable for use in the natural draft heaters described herein.

In some embodiments, the flame scanner may also be configured to allow a small amount of purge air into the flame scanner, e.g., such that the purge air blows across the lens of the flame scanner to keep the lens of the flame scanner clear of dust that may fall from within the heater shell. For example, in the embodiment depicted in FIG. 6, the at least one burner assembly 212 includes a purge air injection input 246 positioned adjacent the flame scanner 224 to deliver purge air directly to the burner. Such a configuration advantageously allows the purge air to be used as combustion air by the burner thereby reducing $NO_x$ formation within the heater shell. For example, since the air being injected into the flame scanner ultimately passes to the burner within the burner assembly, it combines with the combustible air in the burner assembly. Such a configuration is not typically used in industry as flame scanners are commonly known in the art to be used in other locations, e.g., such as the side walls of the heater shell. In some embodiments, the flame scanners can be mounted at every other burner assembly (e.g. in a natural draft heater having three or more burner assemblies) which ensures that a flame is maintained the plurality of burner assemblies. Without intending to be bound by theory, it should be noted that, if the flame scanners were mounted on the side walls of the furnace as is typically done, then the air would not be combustible air. In such a scenario, the purge air undesirably contributes to higher $NO_x$ emissions exiting the stack.

As noted above, in some embodiments, the burner section of the natural draft heater may include a plurality of burner assemblies. In some embodiments, the flame scanner and the purge air injection input may be included on alternating burner assemblies when the at least one burner assembly includes at least two or more burner assemblies. For example, in some embodiments, the at least one burner assembly may include eight burner assemblies and every other burner assembly (four in total) may include a flame scanner mounted within the burner assembly looking upwards at the burner tips to ensure that the burner tips are operating correctly and a purge air injection input adjacent thereto. In some embodiments, for example, the flame scanner and/or the purge air injection input may be absent on at least one burner assembly when the at least one burner assembly includes two or more burner assemblies. In other embodiments, the flame scanner and/or the urge air injection input may be located at every burner assembly.

In some embodiments, the at least one burner assembly may include a pilot burner configuration therein to ensure that the burner remains firing. Referring back to FIGS. 3A and 3B, for example, the at least one burner assembly 212 may include a pilot burner tip 228 in fluid communication with a pilot gas connection 230. In some embodiments, the pilot burner tip 228 may be positioned within the burner 214 to provide a continuous pilot flame within the burner during operation of the natural draft heater. In some embodiments, the pilot gas connection 230 may provide a continuous flow of gas to the pilot burner 230 during operation of the natural draft heater.

As shown in FIG. 1A and as noted above, in one or more embodiments, a natural draft heater system as described herein may include a controller 130 in electrical communication with one or more component within the natural draft heater. For example, the controller may be in electrical communication with the draft sensor 116 and/or the burner air sensor 128. In some embodiments, the controller may also be in communication with the burner air register 218 (e.g., referring to FIG. 3) and/or the one or more actuators 306 (e.g., referring to FIG. 7) in the split range stack damper. In some embodiments, the controller may be in electrical communication with one or more components of the natural draft heater. In some embodiments, the controller 130 may receive an input signal representative of negative pressure of the flue gas from the draft sensor 116 and provide an output signal (from the controller) to the one or more actuators 306 in the split-range stack damper to adjust the positioning of the set of inner blades 302 and the set of outer blades 304 of the split-range stack damper and thereby maintain the bridge wall draft value (e.g., negative pressure within the heater shell proximate the bridge wall) within a preselected range. In some embodiments, the preselected range of the bridge wall draft value may be maintained in the range of about 0.5-inches water-column to about 0.15-inches water-column, or about 0.10-inches water-column to about 0.15-inches water-column to provide the desired negative pressure within the natural draft heater. In some embodiments, the selected preselected range of the bridge wall draft value may be maintained at about 0.10-inches water-column to provide the desired negative pressure within the natural draft heater. In some embodiments, the controller may receive an input signal representative of excess air level from the burner air sensor 128 and provide an alert to an operator to adjust configuration of the one or more plates 218 *b* and thereby control excess air in the burner 214 to a value in the range of between about 15% to about 25% by weight, based on the combined weight of air and fuel needed for complete combustion.

As noted above, some aspects of the disclosure relate to methods of reducing $NO_x$ and CO emissions in a natural draft heater. In one or more embodiments, methods of reducing $NO_x$ and CO emissions in a natural draft heater may include measuring a selected draft value related to the negative pressure of flue gas within the heater shell when operation of the natural draft heater occurs. In some embodiments, such methods may include adjusting a split-range stack damper associated with the natural draft heater to maintain the selected draft value to within a preselected range. For example, in some embodiments according to the disclosure, the preselected range of the selected draft value is maintained in the range of about 0.5-inches water-column to about 0.15-inches water-column, or about 0.10-inches water-column to about 0.15-inches water-column to provide the desired negative pressure within the natural draft heater. In some embodiments, the selected draft value may be maintained at about 0.10-inches water-column to provide the desired negative pressure within the natural draft heater. Generally, a split-range stack damper as described herein above with respect to the natural draft heater systems of this disclosure may also be suitable for use in one or more methods as described herein. For example, in some embodiments, the split-range stack damper may include a set of inner blades, a set of outer blades, and one or more actuators arranged to actuate the set of inner blades and the set of outer blades to thereby effectuate movement thereof to maintain the selected draft value within the preselected range.

In some embodiments, one or more methods as described herein may include measuring an excess air level in a burner when operation of the natural draft heater occurs. In some embodiments, such methods may include controlling excess air in a burner associated with the natural gas heater to a value in the range of between about 15% to about 25% by weight based on the combined weight of air and fuel needed for complete combustion within the burner. In some embodiments, such methods may include controlling the draft within the heater shell within a preselected range thereby to control the amount of excess air in the burner and maintain at least one of $NO_x$ emissions not exceeding 0.025 lb/MMBtu (HHV) and CO emissions not exceeding 0.01 lb/MMBtu (HHV) in the natural draft heater.

In some embodiments, one or methods as described herein may include detecting the presence of a flame in the burner when operation of the natural draft heater occurs. Generally, a flame scanner as described herein above with respect to the natural draft heater systems of this disclosure may also be suitable for use in one or more methods as described herein. For example, in some embodiments, the flame scanner may be positioned directly in the burner. In some embodiments, such methods may include injecting a purge air directly into the burner, the purge air being used as combustion air by the burner to thereby reduce $NO_x$ formation within the heater shell.

In some embodiments, one or more methods as described herein may include sealing one or more connections proximate the burner to prevent air infiltration into the burner to thereby reduce $NO_x$ formation in the heater shell. In some embodiments, the one or more connections may be sealed using air rings and/or a high temperature silicone seal, for example, as referred to herein above with respect to the natural draft heater systems described herein.

In some embodiments, one or more methods described herein include selecting adequate burner and tube circle diameters to induce proper flue gas circulation in the furnace. Generally, the burner and tube circle diameters may vary in commercial natural draft heaters based on fabrication specifications and other design parameters and these specifications may not provide adequate circulation of combustion gases within the burner assembly. Advantageously, the burner and tube diameters may be specifically selected for new fabrications, specifically to ensure an adequate amount of flue gas is internally recirculated and mixed with the combustion air to the burner to provide the desired combustion level within the heater, for example, to ensure complete combustion. The internal recirculation of the flue gas reduces the flame temperature, consequently, decreasing the thermal $NO_x$ emissions in the system.

Finally, one or more methods described herein may also include selectively turning burners out of service at low firing rates to enhance local mixing of air and fuel for in-service burners. Typically, natural draft heaters are operated under a wide range of conditions, for example, based on the desired output from the overall heater assembly. Thus, in times when the heaters are firing at full capacity, or at some degree of reduced capacity, the $NO_x$ and CO emissions may vary greatly. The methods provided herein allow for an operator to selectively turn one or more burner assemblies completely out of service (as opposed to just running at a lower capacity) when the overall heater firing rate is low so as to provide enhanced local mixing of air and fuel in the burner assemblies that remain in service (e.g., because these burner assemblies can run at a higher capacity).

Any one of the methods according to the present disclosure may optionally include providing a natural draft heater having various components and/or design modifications and/or operation schemes as noted herein above with respect to the natural draft heater systems of the present disclosure. Such methods may include providing a natural draft heater including various components noted herein above, including, but not limited to, a heater shell, a bridge wall, one or more heating coils, a draft sensor, a stack (e.g., including a split-range stack damper), at least one burner assembly (e.g., including one or more of a burner, a burner air sensor, an air plenum, a burner air register, and a fuel supply system), and a controller.

In one or more embodiments a method, for example, may include providing a natural draft heater including a heater shell designed to circulate a flue gas internally therein via negative pressure, the flue gas being generated by combustion of a fuel within the heater shell. In some embodiments, for example, the heater shell may include a base and a burner section positioned proximate the base where combustion of the fuel occurs. In some embodiments, the heater shell may include a radiant section positioned adjacent the burner section to receive heat energy from the burner section and radiate heat energy therefrom and a convective section positioned adjacent the radiant section to provide convection from the radiant section.

In some embodiments, the natural draft heater provided according to the methods provided herein may include a bridge wall connected to the heater shell and positioned between the radiant section and the convective section thereof. In some embodiments, the natural draft heater provided according to the methods provided herein may include one or more heating coils positioned within the heater shell proximate one or both of the radiant section and the convective section. For example, the one or more heating coils may contain a process fluid and the one or more heating coils may be arranged to transfer heat from the circulated flue gas to thereby heat the process fluid. In some embodiments, the natural draft heater provided according to the methods provided herein may include a draft sensor positioned proximate the bridge wall to measure a bridge wall draft value related to the negative pressure of the flue gas within the heater shell.

In some embodiments, the natural draft heater provided according to the methods provided herein may include a stack positioned proximate the convective section of the heater shell for venting of at least a portion of the circulated flue gas to atmosphere. In some embodiments, the stack may include an outer shell and a split-range stack damper positioned within the outer shell to maintain the bridge wall draft of the flue gas being vented from the natural draft heater. In some embodiments, the split-range stack damper may include a set of inner blades, a set of outer blades, and one or more actuators arranged to actuate the set of inner blades and the set of outer blades to thereby effectuate movement thereof.

In some embodiments, the natural draft heater provided according to the methods provided herein may include at least one burner assembly connected proximate the base of the heater shell to combust the fuel when supplied thereto, thereby generating the flue gas that transfers heat to the process fluid contained within the one or more heating coils. In some embodiments, the at least one burner assembly may include one or more components therein. For example, the at least one burner assembly may have a burner positioned within the at least one burner assembly to ignite the fuel when being supplied to the burner. In some embodiments, the at least one burner assembly may include a burner air sensor positioned adjacent the burner to measure a level of excess air. In some embodiments, the at least one burner assembly may include an air plenum adjacent to the burner to distribute air into the burner, the air plenum including an air input to receive atmospheric air. In certain embodiments, the at least one burner assembly may include a burner air register in fluid communication with the air input to direct the atmospheric air into the air plenum. For example, in some embodiments, the burner air register may have a housing, one or more plates attached to the housing and positioned in fluid communication with the air plenum to direct air flow into the air plenum, and a handle attached to the housing to adjust the position of the one or more plates to effectuate a movement thereof. In certain other embodiments, each of the one or more plates may be configurable between one or more of an open position, a partially open position, and a closed positioned to selectively supply air to the air plenum.

In some embodiments, the at least one burner assembly may include a fuel supply system. For example, the fuel supply system may have a fuel input conduit, a primary manifold assembly, and a second, staged manifold assembly.

In some embodiments, the first input conduit may be positioned in fluid communication with the primary manifold assembly to deliver fuel to the primary manifold assembly. In some embodiments, the primary manifold assembly may be positioned in fluid communication with one or both of a burner tip of the burner and the second, staged manifold assembly to deliver fuel to one or both of the burner tip of the burner and the second, staged manifold. In some embodiments, the second, staged manifold assembly may be positioned in fluid communication with another burner tip to deliver fuel to the another burner tip. In certain embodiments, the second, staged manifold assembly may include a staged manifold valve that may be configurable to be in a closed position to shut off fuel flow or in an at least partially open position to direct a preselected amount of fuel to the another burner tip to achieve a desired concentration of air and fuel mixture in the another burner tip.

In one or more embodiments a method, for example, may include providing a natural draft heater including a controller in electrical communication with one or more components within the natural draft heater. For example, in some embodiments, the controller may be in electrical communication with the burner air register, the burner air sensor, the draft sensor, and the one or more actuators in the split-range stack damper.

As noted herein, the methods and systems according to the present disclosure may provide a reduction in one or both of the $NO_x$ and CO emissions from a natural draft heater. CO and $NO_x$ emissions are typically known to provide a trade-off, for example, reducing CO emissions may result in a subsequent increase in $NO_x$ emissions and vis-a-versa. Therefore, selection of the desired process modification according to the methods disclosed herein may depend on the desired $NO_x$ and/or CO emissions to be achieved, Advantageously, it has been discovered that a natural draft heater including all of the additional process steps as described herein above may demonstrate reduction of both $NO_x$ and CO emissions simultaneously to a very high degree, for example, exhibiting $NO_x$ emissions not exceeding 0.025 lb/MMBtu (HHV) and CO emissions not exceeding 0.01 lb/MMBtu (HHV). The table provided in FIG. 8 shows predicted emissions guarantees for natural draft heater systems according to the disclosure including the design features and operational schemes provided herein above, indicating that the predicted $NO_x$ emissions will not exceed 0.025 lb/MMBtu (HHV) and the predicted CO emissions will not exceed 0.01 lb/MMBtu (HHV). As depicted in FIG. 8, guarantees are provided for operation of the natural draft heater system under design capacity with 15% excess air ("Design w/15% Excess Air), design capacity with 25% excess air ("Design w/25% Excess Air), normal start of run conditions ("Normal SOR"), normal end of run conditions ("Normal EOR"), and end of run turndown condition ("EOR-Turndown").

EXPERIMENTAL

Prototype testing was conducted based on a single burner assembly configuration in a test furnace simulating the thermal profile of a natural draft heater. Testing was conducted in the test furnace to determine the impact of various design parameters on $NO_x$ emissions using two different types of fuels, for example, using a liquefied petroleum gas (LPG) fuel gas and a low BTU fuel gas. The particular design parameters evaluated included the effect of air rings (installed or uninstalled), the effect of closing the staged manifold valves, and the impact on excess air. It should be noted that the results presented herein are not intended to be limiting of embodiments of the systems and methods of the present disclosure as will be understood by those skilled in the art, and the particular results presented herein are presented by way of example alone. Generally, it should be noted that actual magnitudes of impact on a natural draft heater by various design methods may be varied based on the actual heater furnace geometry and/or the number of burners in operation and/or the particular configuration of the heater itself.

FIG. 9 illustrates a graph showing the impact of various burner design parameters on $NO_x$ emissions using a LPG fuel gas during prototype testing. As illustrated in FIG. 9, the results of prototype testing show that removing the air rings during operation, closing the staged fuel valves during operation, and operating the heaters at high excess air levels (e.g., in the range of about 15% to about 25% excess air by weight, based on the combined weight of the air and fuel to be combusted) generally increased $NO_x$ emissions at higher operating conditions within the heater. However, this increase in $NO_x$ emissions resulted in reduction of CO emissions during testing. It should also be noted that the $NO_x$ emissions appeared to decrease at higher firing rates when the excess air level in the heater was maintained at about 25% excess air. In addition, as demonstrated in FIG. 9, when air rings were installed during prototype testing the $NO_x$ emissions decreased when the excess air level in the heater was maintained at 25% excess air.

FIG. 10 illustrates a graph showing the impact of various burner design parameters on $NO_x$ emissions using a low BTU fuel gas during prototype testing. As illustrated in FIG. 9, the results of prototype testing show that removing the air rings during operation, closing the staged fuel valves during operation, and operating the heaters at high excess air levels (e.g., in the range of about 15% to about 25% excess air by weight, based on the combined weight of the air and fuel to be combusted) generally increased $NO_x$ emissions at higher operating conditions within the heater. However, this increase in $NO_x$ emissions resulted in reduction of CO emissions during testing. It should also be noted that the $NO_x$ emissions appeared to decrease at higher firing rates when the excess air level in the heater was maintained at about 25% excess air.

All $NO_x$ emissions values presented in FIGS. 9 and 10 are represented in units of parts per million (ppm) $NO_x$, dry and corrected to 3% O2. All heater firing rates/operation capacities presented in FIGS. 9 and 10 are represented in units of MMBtu/hour lower heating value (LHV).

This application is a continuation of U.S. Non-Provisional application Ser. No. 15/929,932, filed May 29, 2020, titled "METHODS AND SYSTEMS FOR MINIMIZING NOX AND CO EMISSIONS IN NATURAL DRAFT HEATERS," which claims priority to and the benefit of U.S. Provisional Application No. 62/854,372, filed May 30, 2019, titled "METHOD AND APPARATUS FOR MINIMIZING NOX AND CONTROLLING CO EMISSIONS IN NATURAL DRAFT VERTICAL FURNACES," the disclosures of which are incorporated herein by reference in their entireties.

Having the benefit of the teachings presented in the foregoing descriptions, many modifications and other embodiments of the disclosure set forth herein will come to mind to those skilled in the art to which these disclosures pertain. Therefore, it is to be understood that the disclosure is not to be limited to the specific embodiments disclosed and that modifications and other embodiments are intended to be included within the scope of the appended claims.

Although specific terms are employed herein, they are used in a generic and descriptive sense only and not for purposes of limitation.

That is claimed is:

1. A natural draft heater system comprising:

a heater shell having a base and configured to circulate a flue gas internally therein via negative pressure, the flue gas generated by combustion of a fuel within the heater shell;

one or more heating coils positioned within the heater shell and arranged to transfer heat to a process fluid therein from the circulated flue gas;

a draft sensor positioned within the heater shell to measure a negative pressure of the flue gas within the heater shell during operation of the natural draft heater;

a stack attached to the heater shell, thereby to vent at least a portion of the circulated flue gas to atmosphere, the stack including an outer shell and a split-range stack damper positioned within the outer shell to maintain a negative pressure of the flue gas when vented from the natural draft heater, the split-range stack damper including a set of inner blades, a set of outer blades, and one or more actuators arranged to effectuate movement thereof, the one or more actuators including one or more inner actuators arranged to actuate the set of inner blades and one or more outer actuators arranged to actuate the set of outer blades;

at least one burner assembly connected proximate the base of and within the heater shell to combust the fuel when supplied thereto, thereby to generate the flue gas, the at least one burner assembly having:

a burner positioned within the at least one burner assembly to ignite the fuel when supplied to the burner, a burner air sensor positioned directly adjacent the burner to measure a level of excess air, an air plenum adjacent to the burner to distribute air into the burner, the air plenum including an air input to receive atmospheric air, a burner air register in fluid communication with the air input, thereby to direct the atmospheric air into the air plenum, the burner air register including a housing and one or more plates attached to the housing and positioned in fluid communication with the air plenum, thereby to direct air flow selectively into the air plenum, and a fuel supply assembly including at least a fuel input conduit to deliver fuel to the burner; and a controller in electrical communication with the burner air register, the burner air sensor, the draft sensor, and the one or more actuators to control the negative pressure of the flue gas within the heater shell, thereby to deliver an amount of excess air to the burner to a value in a selected range of between about 15% to about 25% by weight based on the combined weight of air and fuel needed for complete combustion and maintain at least one of NOx emissions so as not to exceed 0.025 lb/MMBtu (HHV) and CO emissions not to exceed 0.01 lb/MMBtu (HHV) in the natural draft heater, the controller configured to receive an input signal representative of negative pressure of the flue gas from the draft sensor, provide an output signal to the one or more actuators in the split-range stack damper, thereby to adjust the position of the set of inner blades and the set of outer blades of the split-range stack damper and maintain the negative pressure of the flue gas to within a selected range, and provide the output signal to each of the one or more inner actuators and the one or more outer actuators, the one or more inner actuators configured to adjust the position of the set of inner blades in response to the output signal being within a first threshold range, and the one or more outer actuators configured to adjust the position of the set of outer blades in response to the output signal being within a second threshold range, the second threshold range being different than the first threshold range.

2. The natural draft heater system of claim 1, wherein the output signal comprises a current delivered to the one or more actuators, the current having a range of about 2 mA to about 20 mA, and wherein the one or more actuators is arranged to adjust the position of at least one of the set of inner blades and the set of outer blades in response to the current received.

3. The natural draft heater system of claim 1, wherein the controller receives an input signal representative of excess air level from the burner air sensor.

4. The natural draft heater system of claim 3, wherein the controller alerts an operator to adjust configuration of the one or more plates, thereby to control the excess air in the burner to a value in the selected range.

5. The natural draft heater system of claim 1, wherein the heater shell includes (a) a burner section positioned proximate the base and in a location where combustion of the fuel occurs, (b) a radiant section positioned adjacent the burner section to receive heat energy from the burner section and radiate heat energy therefrom, and (c) a convective section positioned adjacent the radiant section to provide convection from the radiant section.

6. The natural draft heater system of claim 5, further comprising a bridge wall connected to the heater shell and positioned between the radiant section and the convective section thereof.

7. The natural draft heater system of claim 6, wherein the draft sensor is positioned proximate the bridge wall such that the negative pressure of the flue gas is measured proximate the location of the bridge wall.

8. The natural draft heater system of claim 1, wherein the at least one burner assembly comprises a plurality of burner assemblies positioned in sequence along the base of and within the heater shell, thereby to provide substantially even heating within the heater shell, the plurality of burner assemblies independently controlled and operated during operation of the natural draft heater, such that when one or more of the plurality of burner assemblies is removed from service during operation of the natural draft heater, the remaining burner assemblies remain operational.

9. The natural draft heater system of claim 1, wherein the burner air sensor is configured to measure the level of excess air along a length of the at least one burner assembly.

10. The natural draft heater system of claim 1, wherein the burner air sensor is positioned in a main duct of the at least one burner assembly.

11. A natural draft heater system comprising:

a heater shell having a base and configured to circulate a flue gas internally therein via negative pressure, the flue gas generated by combustion of a fuel within the heater shell;

one or more heating coils positioned within the heater shell and arranged to transfer heat to a process fluid therein from the circulated flue gas;

a draft sensor positioned within the heater shell to measure a negative pressure of the flue gas within the heater shell during operation of the natural draft heater;

a stack attached to the heater shell, thereby to vent at least a portion of the circulated flue gas to atmosphere, the stack including an outer shell and a split-range stack damper positioned within the outer shell to maintain a negative pressure of the flue gas when vented from the natural draft heater, the split-range stack damper including a set of inner blades, a set of outer blades, and one or more actuators arranged to effectuate movement thereof, the one or more actuators including one or more inner actuators arranged to actuate the set of inner blades and one or more outer actuators arranged to actuate the set of outer blades;

at least one burner assembly connected proximate the base of and within the heater shell to combust the fuel when supplied thereto, thereby to generate the flue gas, the at least one burner assembly having:

a burner positioned within the at least one burner assembly to ignite the fuel when supplied to the burner, a burner air sensor positioned directly adjacent the burner to measure a level of excess air, an air plenum adjacent to the burner to distribute air into the burner, the air plenum including an air input to receive atmospheric air, a burner air register in fluid communication with the air input, thereby to direct the atmospheric air into the air plenum, the burner air register including a housing and one or more plates attached to the housing and positioned in fluid communication with the air plenum, thereby to direct air flow selectively into the air plenum, and a fuel supply assembly including at least a fuel input conduit to deliver fuel to the burner; and a controller in electrical communication with the burner air register, the burner air sensor, the draft sensor, and the one or more actuators to control the negative pressure of the flue gas within the heater shell, thereby to deliver an amount of excess air to the burner to a value in a selected range of between about 15% to about 25% by weight based on the combined weight of air and fuel needed for complete combustion and maintain at least one of NOx emissions so as not to exceed 0.025 lb/MMBtu (HHV) and CO emissions not to exceed 0.01 lb/MMBtu (HHV) in the natural draft heater, the controller configured to (a) alert an operator to adjust configuration of the one or more plates, thereby to control the excess air in the burner to a value in the selected range, (b) receive an input signal representative of negative pressure of the flue gas from the draft sensor, (c) provide an output signal to the one or more actuators in the split-range stack damper, thereby to adjust the position of the set of inner blades and the set of outer blades of the split-range stack damper and maintain the negative pressure of the flue gas to within a selected range, and (d) provide the output signal to each of the one or more inner actuators and the one or more outer actuators, the one or more inner actuators configured to adjust the position of the set of inner blades in response to the output signal being within a first threshold range, and the one or more outer actuators configured to adjust the position of the set of outer blades in response to the output signal being within a second threshold range, the second threshold range being different than the first threshold range.

12. The natural draft heater system of claim 11, wherein the output signal comprises a current delivered to the one or more actuators, the current having a range of about 2 mA to about 20 mA, and wherein the one or more actuators is arranged to adjust the position of at least one of the set of inner blades and the set of outer blades in response to the current received.

* * * * *